US006164063A

United States Patent [19]

Mendler

[11] Patent Number: 6,164,063

[45] Date of Patent: Dec. 26, 2000

[54] APPARATUS AND METHOD FOR EMISSIONS CONTAINMENT AND REDUCTION

[76] Inventor: Edward Charles Mendler, 3522 Northampton St., NW., Washington, D.C. 20015

[21] Appl. No.: 09/350,181

[22] Filed: Jul. 9, 1999

Related U.S. Application Data

[60] Provisional application No. 60/093,186, Jul. 12, 1998.

[51] Int. Cl.[7] ..... F01N 3/00

[52] U.S. Cl. ..... 60/274; 60/278; 60/307; 60/297

[58] Field of Search ..... 60/278, 309, 281, 60/297, 274

[56] References Cited

U.S. PATENT DOCUMENTS

| | | | |
|---|---|---|---|
| 2,021,690 | 11/1935 | Kaufman | 60/309 |
| 3,100,146 | 8/1963 | Huntington | 60/309 |
| 3,645,098 | 2/1972 | Templin et al. . | |
| 4,069,666 | 1/1978 | Nakamura | 60/278 |
| 5,121,602 | 6/1992 | McCorvey | 60/309 |
| 5,589,143 | 12/1996 | Mori et al. | 60/297 |

OTHER PUBLICATIONS

SAAB, Saab Exhaust Recirculation Concept: Dramatically Reduces cold–start emissions, SAAB Press Release, Mar. 1996.

*Primary Examiner*—Thomas Denion
*Assistant Examiner*—Thai-Ba Trieu

[57] ABSTRACT

Internal combustion engine exhaust gas, passing unreacted through an exhaust gas catalytic or thermal reaction device during the warm-up period of the device, are directed to a rigid conduit that retains the entire flow. The conduit retains the unreacted gas in sequential alignment with a second non-harmful gas occupying the conduit prior to inflow of the unreacted gas. The second gas blocks flow of the unreacted gas out of the downstream end of the conduit and into the atmosphere. The length and diameter of the conduit minimizes mixing of the unreacted gas and the second gas, and minimizes the volume of the conduit required to retain the unreacted gas. After warm-up of the reaction device, the retained unreacted gas is recirculated to the engine induction system or the reaction device. This approach supplements the emission control of the reaction device by preventing emission of undesirable exhaust gas constituents during starting of the engine and warm-up of the reaction device.

22 Claims, 9 Drawing Sheets

APPARATUS AND METHOD FOR EMISSIONS CONTAINMENT AND REDUCTION

PROVISIONAL APPLICATION REFERENCE

This application relates to Provisional Application Ser. No. 60/093,186 having a filing date of Jul. 12, 1998.

BACKGROUND OF THE INVENTION

The present invention is directed to a system for reducing the harmful exhaust gas emissions of internal combustion engines and, more particularly, to a method and apparatus for containing and reducing the harmful exhaust gas emissions of engines having catalytic converters that are inefficient at low temperatures.

Exhaust gas emissions are the worst during approximately the first 60 seconds of the operation of an engine employing a catalytic converter because the catalytic converter is below its "light-off" temperature and unable to effectively reduce harmful exhaust emissions. Exhaust gas emissions may also be high at the beginning of engine operation because the fuel-air mixture may be fuel-rich during engine starting.

An expandable exhaust container can be used to trap the exhaust emissions during engine starting, however expandable exhaust containers are not expected to attain durability requirements at reasonable cost. A further problem with expandable exhaust containers is that they cannot be packaged easily into available spaces within the automobile. The expandable exhaust container could be made smaller for improved packaging within the automobile, however, that would compromise the ability of the expandable exhaust container to trap the harmful exhaust emissions. Expandable exhaust containers are shown in U.S. Pat. No. 3,645,098 issued to Robert J. Templin et al. (Feb. 29, 1972), and in SAAB Automobile AB press release titled "Saab Exhaust Recirculation Concept: Dramatically reduced cold-start emissions" (March 1996). Durability is a significant problem considering that the state of California has enacted new tailpipe emission regulations including an exhaust emission control system certification requirement of 120,000 miles or 12 years, whichever occurs first (State of California, Air Resources Board, Amendments to California Exhaust, Evaporative and Refueling Emission Standards and Test Procedures for Passenger Cars, Light-duty Trucks and Medium-duty Vehicles "LEV II", enacted Nov. 5, 1998). Durability, and consequently material and manufacturing costs, are expected to continue to be significant problems for expandable exhaust containers considering the temperature and the adverse chemical composition of the exhaust gas.

As an alternative to trapping all of the exhaust gas during engine starting in an expandable exhaust container, U.S. Pat. No. 3,645,098 shows an exhaust canister with trapping agents that trap the harmful constituents of the exhaust gas and that lets the inert non-harmful constituents of the exhaust gas flow out of the canister. A problem with exhaust gas canisters with trapping agents is that they do not effectively trap all of the harmful constituents of the exhaust gas. A further problem with exhaust gas canisters with trapping agents is that of insufficient durability. In particular, the temperature and water content of the exhaust gas can degrade the effectiveness and functional life of low-cost low-temperature trapping agents such as activated charcoal. Flow of exhaust gas through the trapping agent could be terminated before the trapping agent overheats to improve durability, however that would compromise the ability of the trapping agent to trap harmful exhaust emissions.

California enacted a Super Ultra Low Emission Vehicle (SULEV) standard, that has emission certification levels 93% more stringent than the current ULEV standard for oxides of nitrogen (NOx), 82% more stringent for non-methane organic gasses (NMOG), and 75% more stringent for particulate matter (PM). Honda has a prototype emission system capable of attaining the proposed SULEV emission levels, however, system durability to 100,000 miles is a problem and Honda has stated that its technology currently costs about $1000 more than its current production emission systems, which is prohibitively expensive.

Therefore, the objectives of the present invention are to employ an exhaust container having a ridged non-expandable construction to achieve and/or surpass durability requirements, to retain and recirculate to the engine all of the exhaust gas during engine starting to prevent or minimize exhaust of some of the harmful exhaust gas constituents, to have a small size practical for automotive applications and to have a low cost. A further objective is to provide an exhaust container that can easily be form fit into the spaces available within the vehicle.

SUMMARY OF THE INVENTION

By the present invention, harmful exhaust gas emissions during the cold start-up of an engine are diverted from an exhaust pipe to a sequential flow gas containment conduit or "SFGC" conduit, when a catalytic converter is below its operational or "light-off" temperature. The SFGC conduit has a ridged construction, and does not inflate or change shape during operation. Prior to engine starting, the SFGC conduit if filled with a second gas such as air or exhaust gas that contains no or almost no harmful emissions (e.g. air or exhaust gas that has been catalytically cleaned). The harmful exhaust gas emissions diverted from the exhaust pipe enter one end of the SFGC conduit and push the second gas out of the other end of the SFGC conduit. The second gas, and the length and shape of the conduit effectively blocks the harmful exhaust gas from escaping out of the far end of the conduit before almost all of the second gas has been purged from the SFGC conduit. When the catalytic converter reaches its operational temperature, the flow of exhaust gases through the exhaust pipe is reestablished, and the harmful exhaust gases retained in the SFGC conduit are directed to the engine intake. The harmful exhaust gases in the SFGC conduit pass through the engine a second time and then through the catalytic converter, now warmed up, where they are catalytically reduced, thereby greatly reducing engine starting exhaust emissions. In the preferred embodiment, the catalytic converter will reach its operational temperature and the flow will be reestablished to the exhaust pipe before any harmful exhaust gas escapes from the downstream end of the SFGC conduit. Harmful exhaust gas emissions are also diverted to the SFGC conduit at other times when the emissions are particularly dirty, such as during hard acceleration.

The SFGC conduit can be form-fit and packaged significantly better into available spaces in the vehicle than inflatable exhaust gas holding containers, enabling larger containment volumes to be achieved. The SFGC conduit is fabricated out of ridged material, and is significantly less expensive and more reliable and durable than prior art inflatable exhaust gas holding containers. The present invention is expected to surpass the future 150,000 mile durability certification requirement that has been proposed by the California Air Resources Board. The present invention provides a low cost practical means for improving the emission levels of light-duty vehicles including passenger cars and light duty trucks, and is capable of reducing the emission levels of ULEV certified vehicles to the SULEV certification level at low cost.

DETAILED DESCRIPTION OF THE EMBODIMENTS

Figure 1:
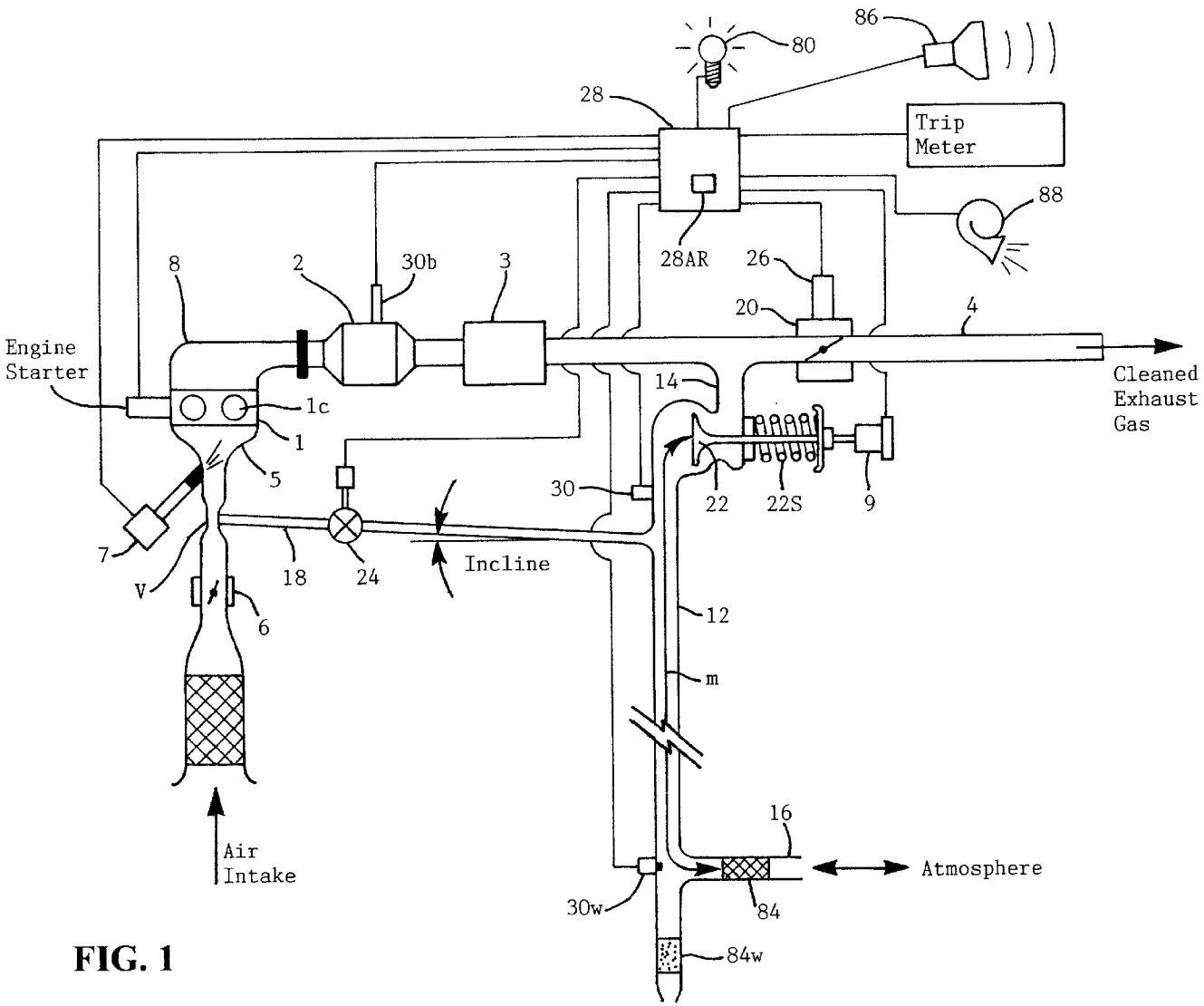
FIG. 1 is a schematic illustration of a first embodiment of the apparatus according to the present invention for reducing exhaust gas emissions with a SFGC conduit.

FIG. 1 schematically illustrates a first embodiment of the present invention. As can be seen from FIG. 1, an exhaust path from an engine 1 passes through a catalytic converter or other emission reaction, reduction or trapping device 2, a muffler 3, and an exhaust pipe 4 to the atmosphere. In a first embodiment of the present invention, the engine 1 includes an air intake manifold 5, a throttle 6, one or more fuel injectors 7, one or more combustion chambers 1*c*, and an exhaust manifold 8. The engine 1 can be a spark ignition engine, a diesel engine, a Stirling engine, or other type of engine or machine that employs one or more catalytic converters or other emission reducing and/or trapping devices that are inefficient at low temperatures or during certain periods of engine operation. With respect to the health effects on humans resulting from inhalation of exhaust gasses, the exhaust gas has a plurality of harmful and non-harmful constituents, such as harmful hydrocarbon, carbon monoxide, oxides of nitrogen, and particulate emissions, and non-harmful nitrogen dioxide, carbon dioxide, and water vapor gasses.

The apparatus according to the present invention for reducing harmful exhaust gas constituents at start-up of engine 1 includes a sequential flow gas containment "SFGC" conduit 12 having a substantially fixed volume and that is in fluid communication with the path of the exhaust gases from the engine such as by means of an inlet conduit 14, so that the exhaust gases can flow into the SFGC conduit 12 during start-up of the engine. The SFGC conduit 12 is also in communication with ambient air through a two-directional flow pipe 16 and with the intake manifold 5 of the engine through a recirculation conduit 18. Two directional flow pipe 16 may simply be the end of conduit 12. Flow through the exhaust pipe 4 is controlled by a valve 20 positioned downstream of the connection of inlet conduit 14 with the exhaust pipe 4. The valve 20 is opened and closed by an actuator 26, such as a solenoid, which is controlled by a controller 28. Flow through the inlet conduit 14 is controlled by a one-way valve 22 which opens to allow the flow from the exhaust pipe 4 into the upstream end of SFGC conduit 12, when the pressure in the exhaust pipe is greater than the pressure in the SFGC conduit 12, but prevents flow in the opposite direction. Preferably valve 22 is closed by a spring 22*s* and opened by exhaust pressure in inlet conduit 14. Alternatively, valve 22 may be opened and/or closed by other means such as an actuator controlled by controller 28 (not shown). An EGR valve 24 controls recirculation of exhaust gases from the SFGC conduit 12 to the intake air manifold 5 by controlling flow of gases through the recirculation conduit 18.

Catalytic converter 2 can effectively promote reaction of harmful exhaust gas constituents under most conditions of engine operation, and emission of such harmful exhaust constituents into the atmosphere is thereby prevented. However, catalytic converter 2 must be heated to a minimum temperature to cause the necessary reactions. Catalytic converter 2 is easily heated by the exhaust gas, but a period of time of about 30 to 90 seconds is usually required before the catalytic converter reaches the minimum temperature. Thus exhaust gases formed when starting the engine and during initial operation are not effectively reacted. Referring to FIG. 1, the present invention therefore provides a valve 20 operated by controller 28 which is responsive to a catalytic converter temperature sensor 30*b* or other sensors, signals, or controls (such as an engine starting control algorithm) to divert the flow of exhaust gases through inlet conduit 14 to SFGC conduit 12. Specifically, controller 28 closes the valve 20 in order to direct the exhaust gas into SFGC conduit 12 when the catalytic converter is below the minimum temperature and unable to effectively reduce harmful exhaust gas constituents, or at other times such as following engine starting when the catalytic converter is warm or the temperature is not known, or when the exhaust gas contains harmful exhaust gas constituents after the catalytic converter has reached the minimum temperature such as during hard acceleration, or during sudden changes in engine power output, or at other times when the fuel/air mixture ratio deviates from the value required for effective reduction of harmful exhaust gas constituents such as during regeneration or purging of the emission control system (for example purging of lean NOx traps, particulate mater traps, etc.) of lean burn engines, gasoline direct injection engines, and diesel engines, or at other times when harmful exhaust gas constituents are present in the exhaust gas flow stream.

Figure 2C:
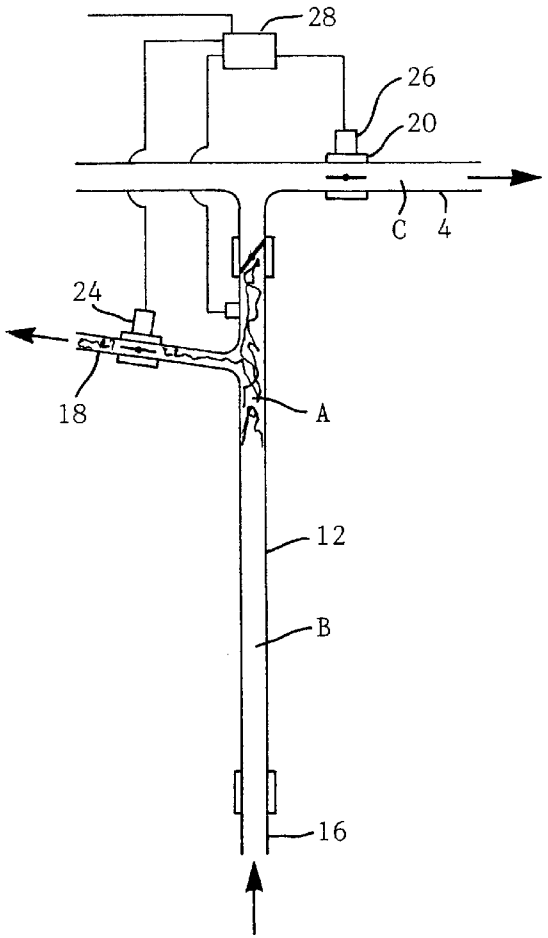
FIGS. 2*a*, 2*b*, and 2*c* are detailed views of the SFGC conduit showing its operational sequence.
Figure 2B:
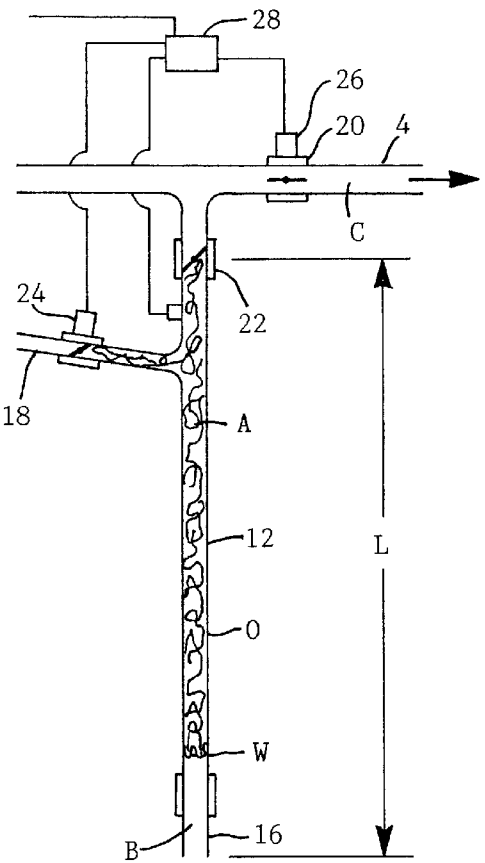
Figure 2A:
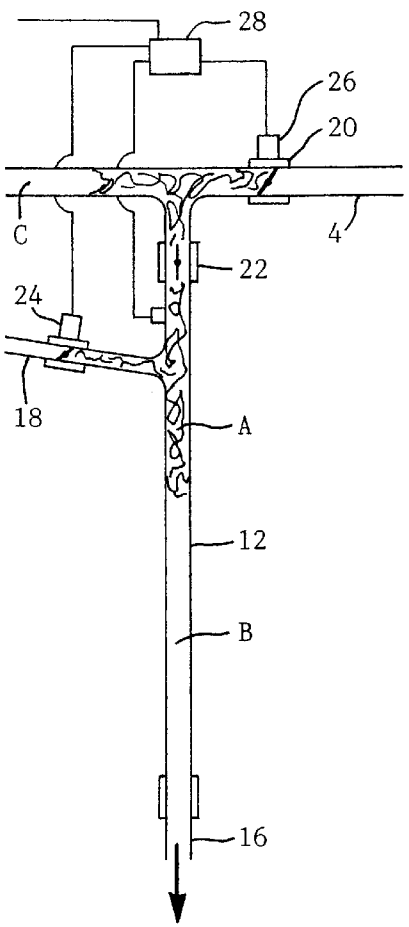

FIGS. 2*a*, 2*b* and 2*c* show a portion of the present invention similar in construction to the embodiment shown in FIG. 1, and illustrates the method of operation of the present invention, and in particular the method of purifying segments of an exhaust gas stream from an engine containing harmful and non-harmful constituents. As shown in FIGS. 2*a*, 2*b*, and 2*c*, the exhaust flow path includes a segment of the exhaust gas stream containing harmful constituents A, a second gas such as air or exhaust gas that has been catalytically cleaned B, and exhaust gas C that has passed through a warmed-up catalytic converter that catalytically reduced the harmful constituent emissions of the exhaust gas. The exhaust gas segment containing harmful constituents A is in fluid communication with the second gas B, and the second gas B is in fluid communication with the atmosphere. As described previously, the exhaust gas segment A may have harmful emissions because the catalytic converter 2 is below its light-off temperature, or for another reason, such as a change in the fuel-to-air ratio caused during rapid acceleration of the vehicle. Referring to FIG. 2*a*, in operation, the segment of the exhaust gas stream containing harmful constituents A from the engine 1 is trapped in the SFGC conduit 12 by the controller 28 closing the valve 20 and blocking the exhaust passage. The closing of the valve 20 increases the pressure in the exhaust pipe 4 and inlet conduit 14 upstream of valve 20, creating a pressure differential across the valve 22 and thereby opening the valve 22 to cause the harmful exhaust gas to flow into the SFGC conduit 12, where the gas is temporarily held. Valve 22 may be a poppet valve (shown in FIG. 1), a butterfly valve (shown in FIGS. 2*a–c*) or another type of valve effective for regulating flow into conduit 12. Valves 20 and 22 may be combined into a single dual action valve. The harmful constituents in exhaust segment A retained in SFGC conduit 12 are generally (e.g., except condensed and/or settled out constituents) in a gaseous state and mixed with the non-harmful constituents of exhaust segment A in SFGC conduit 12.

Referring now to FIG. 2*b*, once the catalytic converter 2 (shown in FIG. 1) has reached its light-off temperature, and is able to effectively reduce exhaust emissions from engine 1, the controller 28 opens the valve 20, and the valve 22 closes. Opening valve 20 opens the exhaust passage and closing valve 22 blocks flow of exhaust into the upstream end of the SFGC conduit 12, causing the exhaust gas C from engine 1, now catalytically cleaned, to vent through exhaust pipe 4, and the segment of the exhaust gas stream containing harmful constituents A to be retained within the SFGC conduit 12.

Referring now to FIG. 2*c*, the controller 28 opens the EGR valve 24 so that the segment of the exhaust gas stream containing harmful constituents A in SFGC conduit 12, except condensed and settled out constituents, flows through exhaust gas recirculation pipe 18 and is recycled back into engine 1 when the catalytic converter is above a minimum temperature for effectively reducing exhaust emissions (e.g., when the catalytic converter 2 is above its light-off temperature). The segment of the exhaust gas stream containing harmful constituents A in SFGC conduit 12 passes through engine 1 a second time, where the harmful constituents may be combusted, and then through the now warmed-up catalytic converter 2, where the remaining harmful constituents are all or nearly all catalytically reduced, thereby greatly reducing engine exhaust emissions.

As the segment of the exhaust gas stream containing harmful constituents A contained within the SFGC conduit 12 is drawn back into engine 1, the SFGC conduit is refilled by the second gas B drawn in through the two-directional flow pipe 16. When the engine is turned off after running for a period of time, the SFGC-conduit 12 is left full of the second gas B. A simple two-directional flow pipe 16 is shown in FIGS. 2*a–c*.

According to the present invention, when the engine 1 is restarted (illustrated in FIG. 2*a*), the controller 28 closes the valve 20 blocking the exhaust passage down stream of the engine to prevent the segment of exhaust gas containing harmful constituents A from venting into the atmosphere, and valve 22 opens directing or diverting the segment of the exhaust gas flow stream containing harmful constituents A into the SFGC conduit 12. SFGC conduit 12 is shaped to effectively retain the segment of the exhaust gas containing harmful constituents A within the SFGC conduit 12 upstream of the second gas B (e.g., up stream of the second gas B that was occupying the SFGC conduit before the inflow of the segment of the exhaust gas containing harmful constituents A). As the segment of the exhaust gas stream containing harmful constituents A enters the SFGC conduit 12, the second gas B in the SFGC conduit is vented through the two directional flow pipe 16 to the atmosphere. The controller 28 opens the valve 20 and closes the valve 22 to open the exhaust passage and block flow of exhaust gas into the upstream end of the SFGC conduit 12 before the exhaust gas entering the upstream end of the SFGC conduit 12 forces the segment of the exhaust gas stream containing harmful constituents A out of the down stream end of the SFGC conduit 12 and into the atmosphere. Alternatively, controller 28 opens valve 20 and blocks flow of exhaust gas into the upstream end of SFGC conduit 12 when catalytic converter 2 has reached the minimum temperature for effective reduction of harmful constituents and/or when the exhaust stream at valve 20 contains no or almost no harmful constituents.

The present invention effectively traps the segment of the exhaust gas stream containing harmful constituents A present during start-up of the engine and recirculates the segment of the exhaust gas stream containing harmful constituents to the engine, thereby greatly reducing engine emissions. The SFGC conduit is ridged in construction and is durable, reliable, and can be fabricated at low cost. Specifically, the present invention does not have a flexible membrane for containing the harmful exhaust emissions. Additionally, the present invention traps and recirculates all or nearly all of the exhaust gasses during engine start-up, and is thus more affective and reliable at reducing engine emissions than prior art systems that employ trapping agents having limited effectiveness of trapping all of the harmful constituents of the exhaust gas.

Referring now to FIG. 2*b* the present invention has a relatively small size that can be easily packaged into automobiles. The size of the present invention, and more particularly the gas containment volume of the SFGC conduit 12, is minimized by establishing a wave front W in SFGC conduit 12 that effectively separates the segment of the exhaust gas stream containing harmful constituents A from the second gas B within SFGC conduit 12 during operation of the present invention, and more particularly that substantially blocks harmful exhaust emissions from venting out of SFGC conduit 12 into conduit 16 before all or almost all of the second gas B within SFGC conduit 12 passes into conduit 16. As can be seen in FIGS. 2*a* and 2*b*, exhaust gas A is substantively upstream of the second gas B during operation of the present invention.

Referring now to FIGS. 2*a*, 2*b* and 2*c*, exhaust gas stream A in exhaust pipe 4 contains harmful constituents such as NMOG and NOx, and non-harmful constituents such as water vapor and carbon dioxide. The harmful constituents in exhaust gas segment A are retained in conduit 12 in a gaseous state, except for condensed and settled out constituents, and are mixed with the non-harmful constituents of exhaust segment A.

Figure 3:
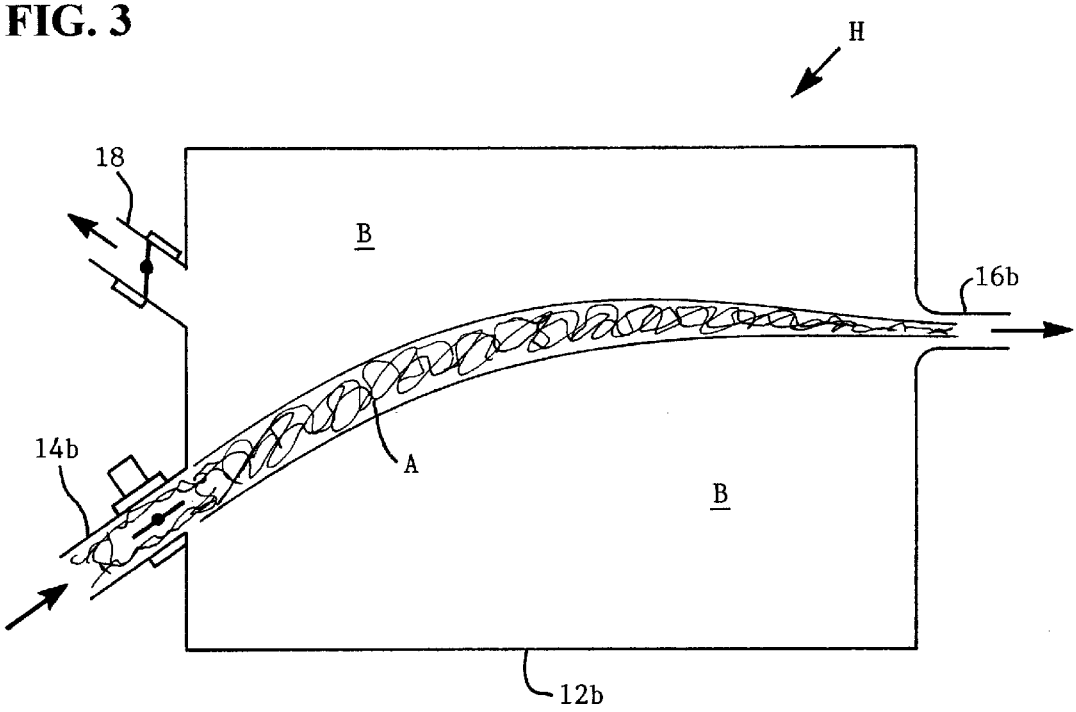
FIG. 3 is a schematic illustration of a hypothetical holding tank.

FIG. 3 shows a hypothetical exhaust gas holding system H that is impractical for automotive applications due to its large volume. System H has an inlet 14*b*, an exhaust gas holding tank 12*b*, an outlet conduit 16*b*, a segment of the exhaust gas stream containing harmful constituents A, and air B. The segment of the exhaust gas stream containing harmful constituents A enters tank 12*b* through inlet 14*b* and flows through tank 12*b* towards outlet 16*b*. Harmful exhaust emissions A first reach outlet 16*b* before a large amount of the air B is vented out of tank 12*b* through outlet 16*b*. Consequently, the volume of holding tank 12*b* for containing all, or almost all, of the segment of the exhaust gas stream containing harmful constituents A is many times larger than the volume of the segment of the exhaust gas stream containing harmful constituents A alone.

Figure 4:
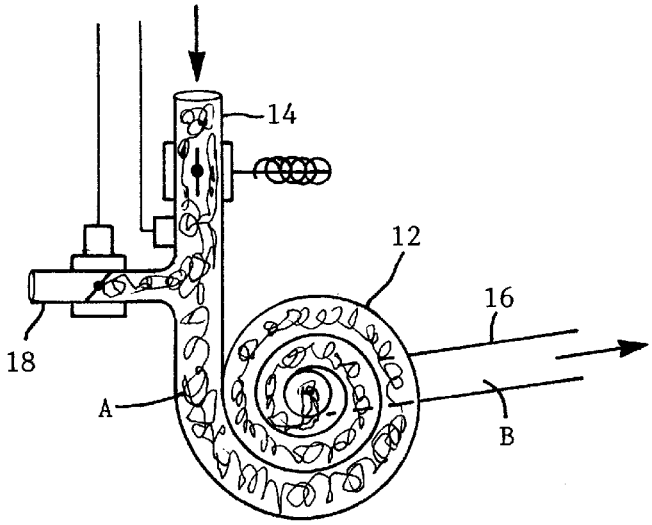
FIG. 4 is schematically illustrates a SFGC conduit that is similar to the SFGC conduit of FIG. 1 except that it is wound into a compact shape.

FIG. 4 shows an arrangement of SFGC conduit 12 according to the present invention where SFGC conduit 12 is wound into a compact shape. The arrangement of SFGC conduit 12 shown in FIG. 4 traps about the same volume of exhaust emissions A as holding tank 12*b* shown in FIG. 3, however, SFGC conduit 12 is much smaller in overall size. Referring to FIG. 4, the segment of the exhaust gas stream containing harmful constituents A enters SFGC conduit 12 through inlet 14, and flows through SFGC conduit 12 towards outlet pipe 16. The segment of the exhaust gas stream containing harmful constituents A reach outlet pipe 16 after almost all of air B has been purged from SFGC conduit 12. Consequently, the volume of conduit 12 required to contain all or almost all of the segment of the exhaust gas stream containing harmful constituents A is at a near minimum. As can be seen in FIG. 2*b*, exhaust gas A is substantively upstream of the second gas B during operation of the present invention. Following opening of valve 22, exhaust gas containing harmful constituents flows into conduit 12. On a volume or mass basis, at a minimum, at least 50% of the gas contained within conduit 12, and specifically downstream of valve 22 before valve 22 is opened, is purged from conduit 12 before any significant amount (less than five percent) of the exhaust gas A containing harmful constituents flowing into conduit 12 after valve 22 opens reaches the downstream end of conduit 12 and/or is released to the atmosphere.

In most embodiments of the present invention, minimizing the total gas containment volume is of critical importance for reducing harmful exhaust emissions considering that many driving trips are short in length. Specifically, start-up exhaust emissions in will not be effectively reduced if the volume of the trapped gas containing harmful constituents is too large to be fully, or almost fully, recirculated back into engine 1 through recirculation conduit 18 during the period of engine operation following engine start-up, and more particularly before use of the engine is ended (e.g., the engine is shut off). According to the present invention, harmful exhaust emissions A in SFGC conduit 12 are directed to manifold 5, and purged from SFGC conduit 12 in less than 20 minutes, and preferably in less than 8 minutes, and preferably within less than 5 miles of driving. Low pressure in manifold 5 caused by throttling will generally be sufficient to draw exhaust gas into manifold 5.

Figure 7:
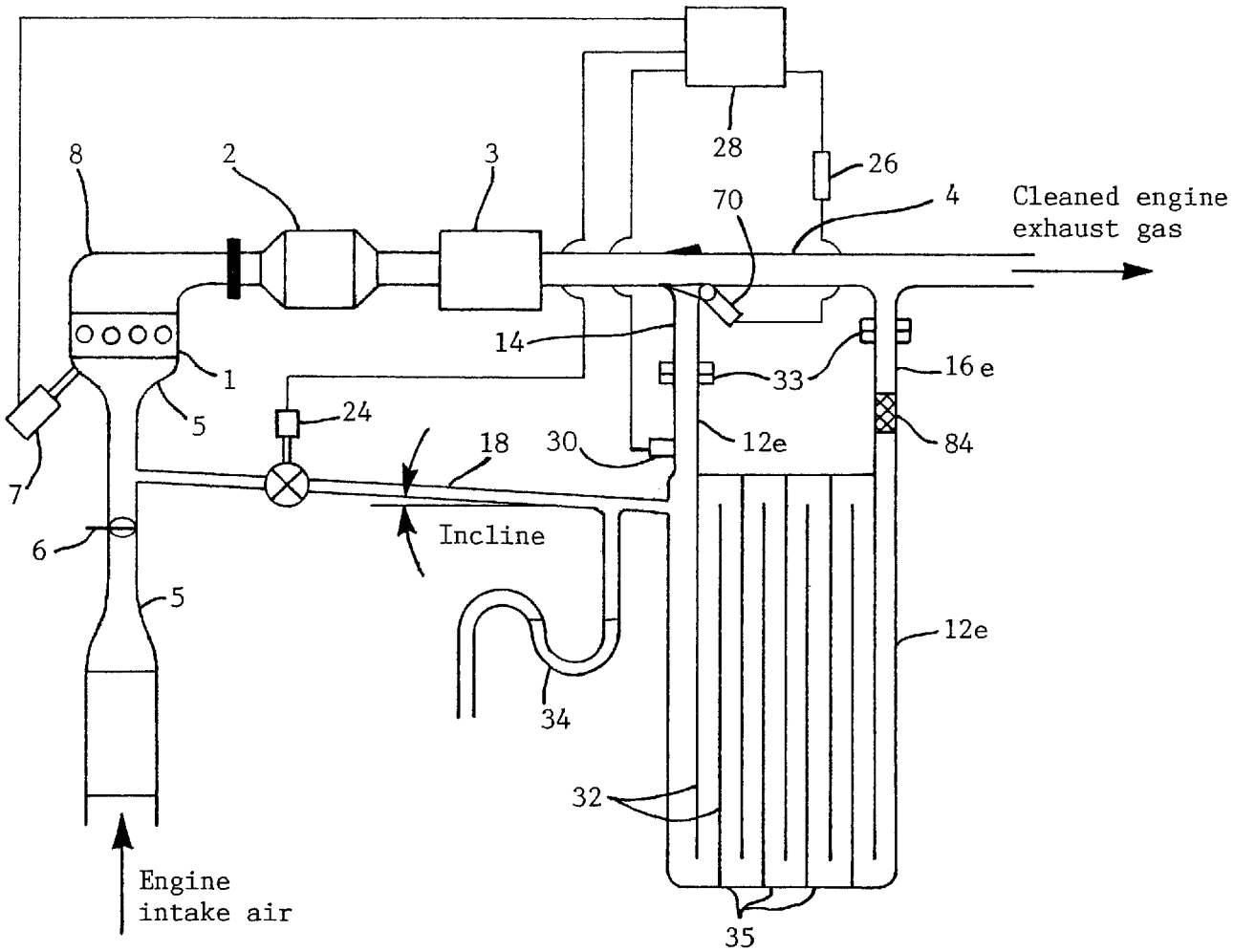
FIG. 7 is a schematic illustration of a second embodiment of the apparatus according to the present invention for reducing exhaust gas emissions with a SFGC conduit.
Figure 7B:
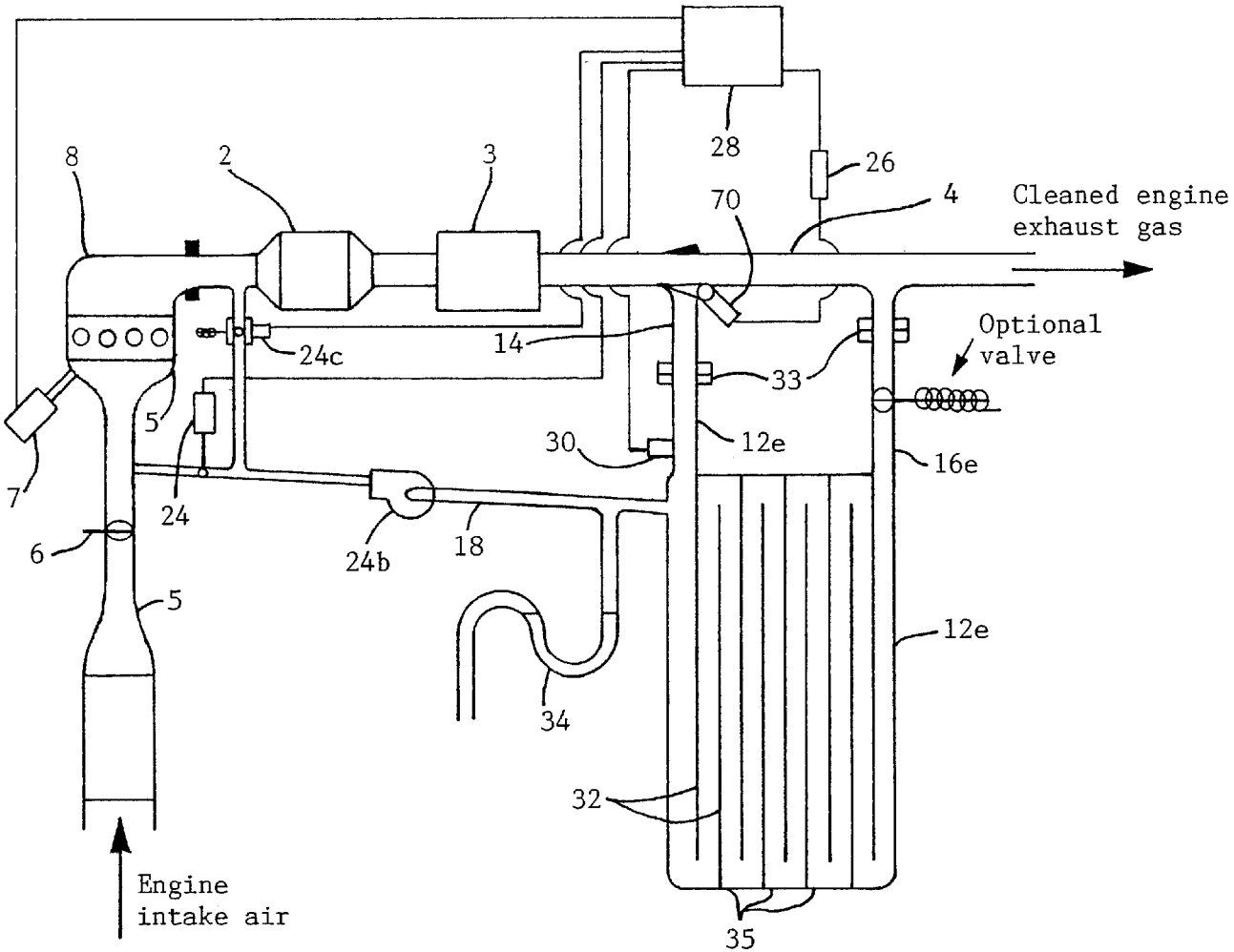
FIG. 7*b* shows a portion of FIG. 7, and includes an optional blower.

Referring to FIG. 7*b*, the purge time can be significantly reduced by a blower 24*b* that blows exhaust gas A containing harmful constituents into the exhaust line upstream of catalytic converter 2. Preferably in systems where the exhaust is recirculated immediately upstream of the catalytic converter, exhaust gas A is not cooled (e.g., within conduits 14, 12*e*, or 18) in systems requiring rapid recirculation of the exhaust gas A, so that the recycled exhaust gas does not cool the catalytic converter below its light-off temperature. Exhaust gas A may optionally be heated by exhaust gas C by a heat exchanger (not shown) or other means. In pressurized systems (FIGS. 1*b* and 8) rapid recirculation of exhaust gas A may be accomplished in a short amount of time without a blower due to the initial pressure of exhaust gas A in the SFGC conduit prior to recirculation. According to the present invention, harmful exhaust emissions A in SFGC conduit 12 are directed to manifold 5, and may be purged from SFGC conduit 12 in less than 4 minutes, and/or within less than 3 miles of driving. According to the present invention, the volume of harmful exhaust emissions in SFGC conduit 12 is at a near minimum, and is small enough to be fully recirculated back into engine 1 on all but the shortest of driving trips. Additionally, the effectiveness of the present invention is further improved by directing the exhaust gas containing harmful constituents A in conduit 12 to manifold 5 (or into the exhaust line upstream of catalytic converter 2) promptly to avoid and/or minimize dissipation and atmospheric release of exhaust A through gas B and conduit 12.

Preferably, the SFGC conduit 12 has a large enough volume that the catalytic converter 2 is warmed up before the SFGC conduit is completely filled with harmful exhaust emissions. However, it might not be necessary or practical to make the SFGC conduit 12 large enough to achieve that goal. In either case, the apparatus according to the present invention at least substantially reduces emission of harmful exhaust emissions.

The effectiveness of the present invention to reduce emissions can be further improved by controller 28 determining the optimum opening and closing timing for valves 20, 22, 24, and/or 70 (shown in FIGS. 1 and 7). For example, SFGC conduit 12 may not be large enough to trap all of the exhaust gas containing harmful constituents A during winter engine operation when the catalytic converter requires more time to warm up. Consequently in some situations some portions of exhaust gas containing harmful constituents may vent into the atmosphere. According to the present invention, controller 28 may predict, or respond to stored data in controller 28, the optimum timing of opening and closing of valves 20, 22, 24, and/or 70 for minimizing emission of harmful constituents into the atmosphere. Controller 28 may be a stand alone controller or incorporated into the primary controller for the engine, and controller 28 may receive sensed and stored data from the primary controller and/or sensors that provide data to the primary controller, as well as other sensors such as temperature sensor 30.

The present invention enables vehicle fuel economy to be improved by enabling flow of fuel to the engine to be greatly reduced (e.g., resulting in a lean fuel-to-air mixture ratio) or terminated when very little or no power is needed from the engine, such as when the vehicle is decelerating, descending a hill, stopped, or when power is being supplied by other means such as an electric or hydraulic motor. Typical catalytic converters are not very effective at reducing NOx emissions from non-stoichiometric combustion byproducts, such as those from lean fuel-to-air mixture ratios. Additionally, in conventional vehicles, reducing or terminating fuel flow to the engine causes emission levels to significantly increase, and in particular when the fuel-to-air mixture ratio deviates from a stoichiometric value. Terminating fuel flow to the engine requires the engine to be restarted, and starting the engine produces high emission levels. According to the present invention, vehicle mileage is improved and emissions are reduced by terminating or greatly reducing fuel flow to the engine (and in particular by turning off the fuel supply or by using a lean fuel-to-air mixture ratio) when power from the engine is not needed or when very little engine power is needed (e.g., less than 10 kilowatts) (such as when the vehicle is decelerating, descending, moving at low speed, stopped, or when power is being supplied by other means), directing the exhaust gas segment(s) containing harmful constituents into the SFGC conduit, and recycling the exhaust gas segment(s) containing harmful constituents through the engine. The engine is turned off or run lean for short periods of time, resulting in reduced fuel consumption and higher mileage, and the resulting segment(s) of the exhaust stream containing higher emission levels are directed to SFGC conduit 12 for purification according to the present invention.

Generally, an exhaust gas containment volume for containing exhaust gas A of less than 400 liters (106 gallons) is practical for passenger cars, and an exhaust gas containment volume for containing exhaust gas A of less than 600 liters (159 gallons) is practical for light-duty trucks (such as pick-up trucks, vans, and sport-utility vehicles). The exhaust gas containment volume for containing exhaust gas A required to effectively reduce emissions according to the present invention is minimized by the SFGC conduit, already described; by reducing the light-off time of the catalytic converter 2 or other emission reduction device; by reducing the exhaust gas flow rate out of the engine before the catalytic converter or other emission reduction device becomes effective; and/or by containing exhaust gas A at elevated pressures. The required containment volume can also be reduced by reducing the amount of emissions reduction being sought. For example, with a large SFGC conduit it may be possible to reduce emissions by over 90%, however, an emissions reduction of only 40% may be required to comply with a tailpipe emissions standard or regulation. The 40% emission reduction level can be attained with a significantly smaller gas containment volume than that required to reduce emissions by 90%.

Referring now to FIG. 1, the required containment volume can also be reduced by placing an optional emissions trap 84, such as an activated charcoal hydrocarbon trap, in conduit 12 and/or in two-directional flow pipe 16. Emissions trap 84 may adsorb, absorb, and/or trap hydrocarbon (such as fuel vapors) and/or other emissions types by other trapping means such as an electrical charge or filter for trapping particulate mater. When controller 28 closes valve 20 and opens valve 22, exhaust gas A flows into SFGC conduit 12. Some of the exhaust gas A containing harmful constituents, such as hydrocarbon emissions, may flow through conduit 12 and into emissions trap 84. Emissions trap 84 traps a significant portion of the harmful constituents, thereby preventing their release into the atmosphere. After the catalytic converter has warmed up, controller 28 opens valve 20, closes valve 22, and opens EGR valve 24, causing the second gas B (preferably air) to flow through emissions trap 84 and into conduit 12. Second gas B flowing through emissions trap 84 purges the harmful constituents from emissions trap 84. The purged emissions from emissions trap 84 are contained in conduit 12 and directed through recirculation conduit 18 into engine 1 (or into the exhaust line of engine 1 upstream of the catalytic converter 2 or other emission reduction device), where the harmful constituents are purified. A water bypass 84*w* (or water drainage trap 34, shown in FIG. 7) may be used to prevent or minimize water condensed out of exhaust gas A from degrading the performance of emissions trap 84. Water bypass 84*w* preferably includes a water permeable material that permits passage of liquid water but largely blocks through flow of exhaust gas or air. Additionally, water bypass 84*w* may includes filtering means for preventing or minimizing passage of pollutants in the bypass water (such as hydrocarbon liquids) from being released to the atmosphere or ground. Alternatively, water bypass 84*w* may include a valve, an open ended drain pipe, or another type of water bypass for draining water out of conduit 12. Water draining out of water bypass 84*w* may drain to the ground or into a holding tank, or be directed back into manifold 5, engine 1, manifold 8 or another location upstream of catalytic converter 2 or other emission reduction device. A sensor 30*w* connected to controller 28 may be used to measure the temperature of the exhaust gas entering emissions trap 84. Controller 28 opens valve 20 and closes valve 22 in response to an overheat signal being received from sensor 30*w*. In general, controller 28 opens valve 20 and closes valve 22 when the gas flowing into emissions trap 84 is above, or estimated to be above, an operational temperature limit where higher gas temperatures would damage emissions trap 84 and/or cause the hydrocarbon and/or other pollutants trapped on or in emissions trap 84 to vaporize and/or be released to the atmosphere. Other sensors and/or other control algorithms may be used to control (e.g., stop) the flow of hot exhaust gas into emissions trap 84 to prevent emissions trap 84 from exceeding its operational temperature limit, such as prediction of the temperature of emissions trap 84 from temperature data received from sensor 30 and an estimation of exhaust gas flow volume entering conduit 12 calculated by controller 28. Low temperature (such as activated charcoal) and high temperature (such as zeolite) trapping agents may be used. Low temperature trapping agents are preferred due to lower system cost. With regard to low temperature trapping agents, the maximum temperature limit of the emissions trap 84 is generally greater than 40° C. and less than 150° C., depending on the type of trapping material used, such as activated charcoal. An operational temperature limit below 80° C. is generally preferable for reasons of retention of evaporative emissions and durability. According to the present invention, emissions trap 84 is placed at a distance m from valve 22 where the emissions trap 84 will remain below its operational temperature limit until after the catalytic converter 2 has reached its light-off temperature, and preferably until after the catalytic converter has reached an effectiveness of at least 80%. According to the present invention, emissions trap 84 remains relatively cool during engine start-up because gas B, which is typically cool, passes through emissions trap 84 first, and because start-up emissions A are significantly reduced in temperate due to heat transfer to the lengthy flow passage from the engine to emissions trap 84. According to the present invention, a thermal gradient is established in SFGC conduit 12, where high temperature exhaust emissions can be trapped in the upstream end of conduit 12 (near valve 22) while only low temperature gas passes through trap 84. In operation, valve 22 is closed before high temperature gas enters trap 84. Preferably emissions trap 84 will remain below its operational temperature limit for at least 60 seconds. Preferably emissions trap 84 is located in two-directional flow pipe 16 or at the end of conduit 12 located away from valve 22 in order to retain a relatively cool operating temperature. More specifically, and according to the present invention, distance m is at least two meters, and more specifically emissions trap 84 is located at least two meters downstream from valve 22 (or valve 70 as shown in FIG. 7), and preferably emissions trap 84 is located at least three meters downstream from valve 22 (or valve 70) in order to retain a cool emissions trap 84 during engine start-up. Distance m is preferably measured along the flow stream centerline between valve 22 and emissions trap 84. It is important to note that a highly effective emissions trap 84 may provide substantive emission reduction levels according to the present invention with a conduit 12 that has a non-optimum construction and some mixing between exhaust gas A and exhaust gas B.

Figure 5:
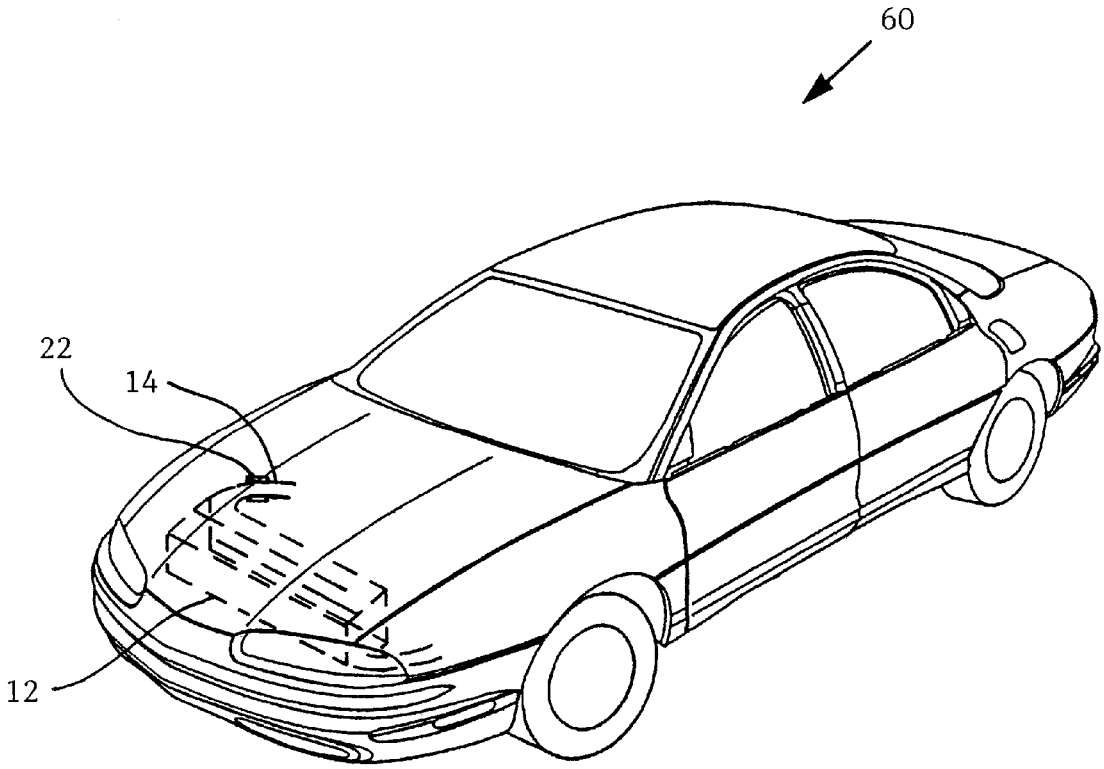
FIG. 5 schematically illustrates the present invention installed in a passenger car.

Referring to FIGS. 1 and 5, the light-off time for the catalytic converter is measured after aging the catalytic converter to 50,000 equivalent miles of on-road vehicle use, and is defined as the time required for the catalytic converter, to (warm-up and) achieve a 50% non-methane hydrocarbon (NMHC) or non-methane organic gasses (NMOG) conversion efficiency following cold starting of the vehicle as measured on the U.S. Federal Test Procedure (FTP) Urban Dynamometer Driving Schedule (UDDS) Cold Start Phase, referred to as the "FTP Cold Start Phase" or the "FTP Bag 1 test". During the first 20 seconds of the FTP Cold Start Phase, the vehicle is idling, and the exhaust gas volume is relatively small, about 3 liters per second per liter of engine displacement D due to the short period of time and due to the fact that the engine is not producing power for propelling the vehicle. In practice, most production vehicles having a close-coupled catalytic converter will have a longer light-off time delay, of about 35 to 45 seconds. According to the present invention, the SFGC conduit gas containment volume needed to effectively reduce harmful exhaust gas emissions is minimized by employing a catalytic converter that lights off in less than 35 seconds on the FTP Cold Start Phase, and preferably that lights off in less than 20 seconds, however lighting off in 20 seconds may not be practical or cost effective for many vehicle types. After the first 20 seconds, the vehicle begins to accelerate, and the exhaust gas flow rate increases significantly. A factor of three (3) is reasonable for scaling the increased exhaust flow rate after the first 20 seconds of operation of the engine on the FTP Cold Start Phase. For cars having an engine displacement D and an engine light off time Lt of at least 20 seconds, the SFGC containment volume Cv required to contain a significant portion (such as all, or almost all) of the exhaust gas A that is exhausted from the engine before the catalytic converter reaches its light off temperature is approximately equal to or less than, $$Cv \leqq 3D20+9D(Lt-20)$$

Simplifying terms we have, $$Cv \leqq D(9Lt-120)$$

Where Cv and D are in liters, and Lt is in seconds. Those skilled in the art will appreciate that the formula provided above provides an estimate of the volume required to contain a significant portion of the emissions from the engine before the catalytic converter reaches its light off temperature, and the actual required volume will be approximately equal to or less than the amount calculated by the formula. Additionally, the required volume will vary from vehicle to vehicle from the volume estimated by the equation due to engine variables such as idle speed, transmission gear shift schedule, fuel-to-air ratio settings, engine and exhaust line geometry, cylinder count, and other variables. More generally, the containment volume Cv is an estimate of the maximum volume required to significantly reduce emission levels for many vehicle types. For engines having a catalytic converter light-off time Lt less than 20 seconds, the containment volume required to contain a significant portion of exhaust gas A may be estimated by assuming Lt equals 20 seconds.

As an example, the present invention can be employed to reduce the emission levels of the Honda ULEV accord to the SULEV emission certification level. Specifically the SULEV emission standard can be attained by trapping and purifying the cold start emissions of the Honda ULEV. In order to reach the SULEV standard, additional emissions may also need to be trapped and purified with the present invention after the catalytic converter has reached its light off temperature, such as post light-off start-up emissions and transient emissions during large changes in engine power output (described in greater detail below). The 1998 model year ULEV Honda Accord has an under-floor catalytic converter that lights off in approximately 25 to 30 seconds. (a close-coupled catalytic converter could reduces the light-off time to about 20 seconds.) The curb weight of the vehicle is about 1400 kilograms, and the displacement of the engine is about 2.3 liters. According to the formula provided above, and assuming a catalytic converter light-off time of 30 seconds, the SFGC containment volume Cv required to contain and purify the emissions exhausted from the engine before the catalytic converter reaches its light off temperature is approximately equal to or less than, $$Cv \leqq 2.3((9\times30)-120)=345 \text{ liters}$$

As described above, Honda has stated that its technology for reducing the emission levels of the ULEV Honda Accord to the SULEV emissions certification level currently costs about $1000 more than the current ULEV emission system. The embodiment of the present invention just described having an SFGC conduit that contains exhaust gas at atmospheric pressure, is expected to increase the current cost of the Honda ULEV Accord by less than $100, which is a significantly smaller marginal cost increase than Honda's proposed system, and many thousands of dollars less costly than the marginal cost increase of an electric vehicle.

Referring to FIGS. 1 and 5, engine and catalytic converter warm-up time is reduced by reducing the cylinder count of the engine and reducing heat loss from the hot exhaust gas to the engine and exhaust manifold. Preferably engine 1 has fewer than three cylinders in order to minimize the catalytic converter light-off time delay. The volume of exhaust gas A containing harmful constituents is also reduced by reducing the displacement of the engine relative to the curb weight of the vehicle. According to the present invention, extremely low emission levels are attained with an engine, preferably having fewer than three cylinders (such as a single cylinder engine as may be employed in hybrid electric vehicles and/or other advanced types of vehicles) placed in a vehicle having a vehicle weight to engine displacement ratio greater than 1200 kilograms of vehicle curb weight Cw per liter of engine displacement D, and a gas containment volume large enough to contain all or almost all of exhaust gas A containing harmful constituents. Use of the small engine according to the present invention, reduces the volume of exhaust gas A, and enables a larger gas containment volume to be employed relative to the volume of exhaust gas A (e.g., the practical size limit of the SFGC conduit gas container within the vehicle generally remains constant while the volume of exhaust gas A requiring purification is greatly reduced due to the small displacement of the engine and the short warm-up time of the engine). In terms of vehicle curb weight, the United States government and industry formed the Partnership for a New Generation of Vehicles (PNGV) in 1993 (*PNGV Program Plan*, Nov. 29, 1995, U.S. Department of Commerce, and *Inventions Needed for PNGV*, March 1995, U.S. Department of Commerce) to attempt development within ten years one or more production prototypes vehicles having a fuel economy of up to three times that of today's comparably sized passenger cars (e.g., a Ford Taurus size car having a fuel efficiency of 80 miles per gallon). Government and industry have set a target curb weight for the vehicle of 2000 pounds (907 kilograms). According to the present invention, at 1200 kg/L, engine displacement for the 2000 pound car is preferably less than, $$D \leqq 907 \text{ kg}/(1200 \text{ kg/L}) = 0.756 \text{ liters}$$

and according to the formula provided above, and assuming a catalytic converter light-off time of 30 seconds, the SFGC containment volume required to contain and purify the emissions exhausted from the engine before the catalytic converter reaches its light-off temperature is approximately equal to or less than, $$Cv \leqq 0.756((9 \times 30) - 120) = 113 \text{ liters}$$

The 113 liter SFGC containment volume can easily be packaged into the vehicle, and the present invention is durable and reliable, and has a small (and production viable) cost. For a light-off time Lt of 20 seconds, according to the present invention, containment volume for the 0.756 liter engine is about 45 liters. A fast light-off catalytic converter can greatly reduce the required containment volume.

While the catalytic converter achieves a 50% conversion efficiency at the end of the light-off time period, more time is required for the catalytic converter to attain a fully warmed-up conversion efficiency, which is typically greater than 90%. Preferably, all of exhaust gas A containing harmful constituents exhausted from the engine before the catalytic converter achieves a high level of effectiveness (for example, greater than 80%) is trapped and purified according to the present invention although that goal may not be practical or cost effective in some vehicles. Preferably, the containment volume is up to doubled in size in order to contain exhaust emissions after the catalytic converter has reached its light-off temperature, but before it has achieved a high level of effectiveness (for example, greater than 80%), however, as just stated it may not be practical or necessary for doubling the size of the SFGC conduit in many vehicle types. Referring now to the example provided above for a vehicle having an engine displacement of 0.756 liters, preferably the vehicle has a containment volume $C_{V2}$ that is up to twice the size of the containment volume Cv calculated above, where, $$C_{V2} \leqq 2Cv \leqq 2D(9Lt - 120) = D(18Lt - 240)$$

For the vehicle having an engine displacement D of 0.756 liters and a catalytic light-off time of 30 seconds we have, $$C_{V2} \leqq 0.756((18 \times 30) - 240) = 226 \text{ liters}$$

In embodiments of the present invention having fewer than three cylinders (and preferably a single cylinder for vehicles having a curb weight under 2000 pounds) and a vehicle weight to engine displacement ratio greater than 1200 kilograms of vehicle curb weight per liter of engine displacement, the volume of exhaust gas A containing harmful constituents is exceptionally small, enabling alternative exhaust gas containment means to be employed such as a pressurized holding container (shown in FIGS. 1*b* and 8); a non-optimized SFGC conduit where some of the specified means for minimizing mixing of exhaust gas A and gas B are not present or below specification in order to further reduce cost and/or further facilitate packaging of the present invention into the vehicle; or an expandable or inflatable exhaust gas container significantly smaller in size and/or having a lower gas containment pressure than prior art systems enabling cost to be reduced and durability to be improved. According to an embodiment of the present invention vehicle 60 has fewer than three cylinders, and exhaust gas A is first trapped in the SFGC conduit or in inflatable exhaust gas container 100, at atmospheric or elevated pressure, and then recycled back to engine 1 and/or catalyst 2 for reduction of harmful emissions.

Figure 8:
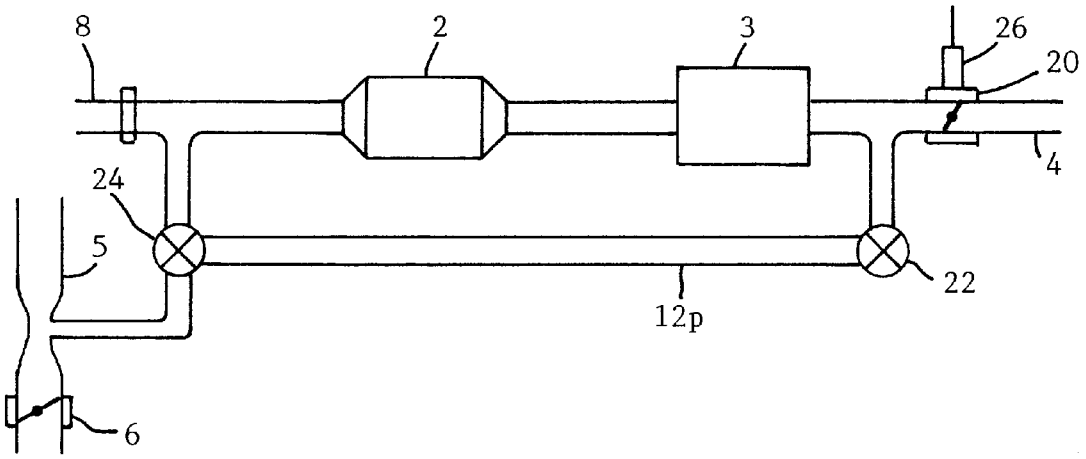
FIG. 8 schematically illustrates a SFGC conduit for containing exhaust gas at elevated pressure.

FIG. 8 is similar to FIG. 1 except that FIG. 8 shows a pressurized conduit 12*p*. During start-up of engine 1, valve 20 and 24 are closed and valve 22 is opened, causing exhaust gas A containing harmful constituents to flow into conduit 12*p*. Exhaust gas A is contained in conduit 12*p* at elevated pressure, enabling the mass of exhaust gas A contained in conduit 12*p* to be significantly increased and/or the geometric containment volume of conduit 12*p* to be reduced. After a significant portion of exhaust gas A has been trapped in conduit 12*p*, valve 20 is opened and valve 22 closed by controller 28, and the exhaust gas from engine 1 flows out of exhaust pipe 4 to the atmosphere. Once catalytic converter 2 has reached its light-off temperature, valve 24 opens, causing the pressurized exhaust gas to flow out of conduit 12*p* and into the exhaust line upstream of catalytic converter 2, where harmful constituents are reduced and then exhausted into the atmosphere through exhaust pipe 4. Alternatively, pressurized exhaust gas in conduit 12*p* may be directed into manifold 5. SFGC conduit 12*p* may be purged by opening valve 22 and closing valves 20 and 24 after catalytic converter 2 has warmed-up, causing purified exhaust gas C to flow through valve 22 and into conduit 12*p*, causing the pressure in conduit 12*p* to increase and residual exhaust gas A to be forced towards valve 24. After conduit 12*p* has an increased gas containment pressure, valve 22 is closed and valve 20 and 24 are opened. With valves 24 and 20 open, the purified exhaust gas C in conduit 12*p* expands and purges all (or almost all) of the exhaust gas A containing harmful constituents out of conduit 12*p* and into the exhaust line upstream of the catalytic converter 2.

Figure 9:
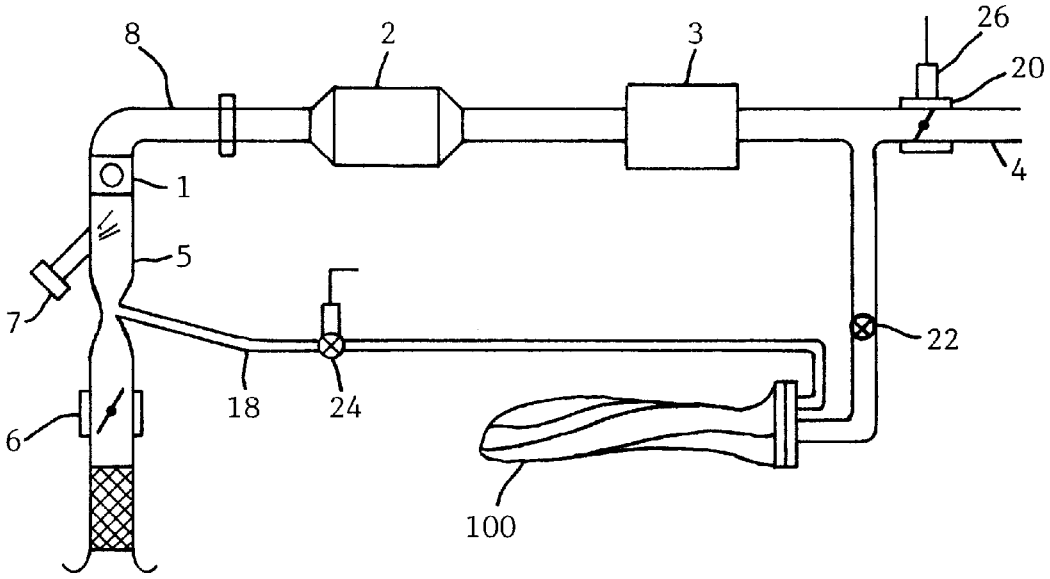
FIG. 9 schematically illustrates an inflatable exhaust gas holding container for application on vehicles having a curb weight to engine displacement ratio greater than 1200 kg/L.

FIG. 9 is similar to FIG. 1 except that FIG. 9 shows a small inflatable bag 100. During engine starting, valve 20 closes and valve 22 opens causing exhaust gas A containing harmful constituents to flow into bag 100, through valve 22. Once catalytic converter 2 has warmed up, valve 22 is closed, valve 20 is opened, and valve 24 is opened, and exhaust gas A containing harmful constituents flows from bag 100 into engine 1 through pipe 18. According to the present invention, vehicles having a curb weight to engine displacement ratio greater than 1200 kilograms per liter of engine displacement, and engines having fewer than three cylinders have exceptionally small bag 100 containment volume Cv requirements. Preferably bag 100 traps all or nearly all engine exhaust gas A before catalytic converter 2 lights off, and preferably bag 100 has a maximum containment volume no greater than 113 liters. The exceptionally small size of bag 100 enables a somewhat lower cost bag to be employed.

Precise catalytic converter light-off time period data can be difficult to obtain. For the purpose of sizing the containment volume required to contain exhaust gas A containing harmful emissions, according to the present invention, catalytic converter light-off time may be measured and/or assumed to be 35 seconds for current and future production light-duty vehicles, including passenger cars and light-duty trucks.

Figure 1B:
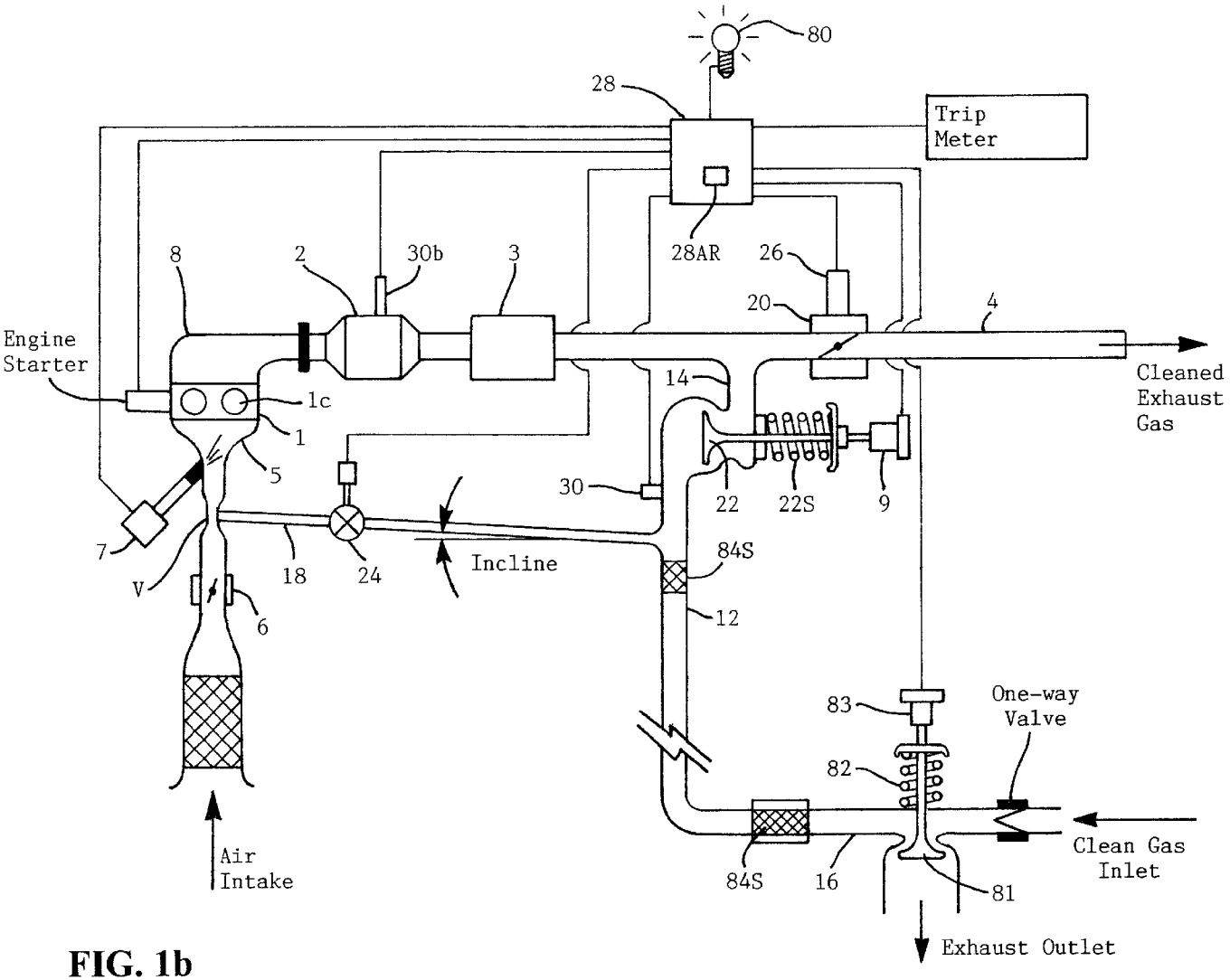
FIG. 1*b* shows a portion of FIG. 1, and includes an optional SFGC conduit outlet valve.

Referring now to FIG. 1*b*, according to the present invention, the exhaust gas containment volume for containing exhaust gas A, can be significantly reduced in size by lightly pressurizing the exhaust gas in the SFGC conduit as described previously in reference to FIG. 8. Specifically, the exhaust gas containment volumes for containing exhaust gas A given above for the SFGC conduits containing exhaust gas at approximately atmospheric pressure, can be approximately reduced in half by allowing the gas pressure in the SFGC conduit to increase to about 24 psi above atmospheric pressure. Those skilled in the art will appreciate that the required gas containment volume for significantly reducing harmful emissions according to the present invention decreases with increasing gas containment pressure within the SFGC conduit. Preferably, the exhaust gas pressure within SFGC conduit 12 is lightly pressurized to a value more than 10 psi above atmospheric pressure, and less than 60 psi above atmospheric pressure, in order to minimize SFGC conduit containment volume, while not requiring a costly SFGC construction for containing high pressures exhaust gas or causing significant back-pressure in the exhaust manifold 8 that would adversely effect operation or performance of the engine. Preferably, the lightly pressurized containment volume Cvp of the SFGC conduit is reduced is size by more than 50% relative to the volume required to contain the same amount of gas at atmospheric pressure Cv, where, $$C_{VP} \leqq C_V/2$$

Additionally, for $C_{V2}$ systems the pressurized containment volume $C_{V2P}$ is, $$C_{V2P} \leqq C_{V2}/2 = C_V$$

According to the present invention, and considering advanced vehicles with a ratio of vehicle curb weight to engine displacement greater than 1200 kg/L, the minimum SFGC conduit containment volume is generally greater than 30 D, and preferably greater than 60 D. In general, the SFGC conduit containment volume is greater than 30 liters, and preferably greater than 60 liters. In any event, conduit 12 is generally large enough to retain at least 30 liters of segment A.

Referring now to FIG. 1*b*, an optional valve 81 may be located in two directional flow pipe 16 or the downstream end of conduit 12. Valve 81 may be closed by a spring 82 or other means such as an actuator controlled by controller 28. Valve 81 is opened by gas pressure in conduit 12 or by other means such as an actuator controlled by controller 28. According to the present invention, a stiff spring 82 may be used so that valve 81 opens only after significant pressure develops in conduit 12. Alternatively, valve 81 may be opened by an actuator after significant pressure develops in conduit 12. Preferably, the pressure in conduit 12 is more than 10 psi above atmospheric pressure before valve 81 opens. According to the present invention, exhaust gas containing harmful constituents is compressed in conduit 12, enabling a smaller SFGC conduit to be used and/or a greater total mass of exhaust gas to be contained and purified according to the present invention. Those skilled in the art will appreciate that valve 81 may be a poppet valve, a butterfly valve, or other type of valve for containing gas in conduit 12. Preferably the maximum pressure in conduit 12 is greater than 10 psi in order to increase the amount of exhaust gas contained in conduit 12, and less than 150 psi in order to minimize the structural requirements of conduit 12 and valves 22 and 81. A maximum pressure below 60 psi is preferable for not causing adverse back pressure in some engines. An added advantage of pressurizing the exhaust line is that the catalytic converter warms up more quickly and the light-off time of the catalytic converter is reduced due to the increased temperature, pressure, and heat transfer within the catalytic converter during engine start-up. Flow straightners 84*s* may be installed inside conduit 12 or conduit 16 to minimize turbulence in side of conduit 12, and subsequent mixing of gasses A and B. Flow straightner 84*s* may be combined with emissions trap 84 (shown in FIG. 1).

According to the present invention, a smaller SFGC conduit containment volume is generally required for lighter vehicles, and a larger containment volume is generally required for heavier vehicles. Specifically, according to the present invention, the SFGC containment volume required to contain and purify the emissions exhausted from the engine before the catalytic converter reaches its light-off temperature is between 0.025 and 0.25 liters per kilogram of vehicle weight, depending on engine displacement and other factors. For example, the Honda ULEV Accord has a curb weight of 1400 kilograms and a 2.3 liter engine. The required SFGC containment volume is then approximately equal to or less than, $$Cv \leqq 0.25Cw = 0.25(1400) = 350 \text{ liters}$$

The size of the SFGC conduit is practical for automotive applications. For example, in a number of mini vans their is open space in the undercarriage of the vehicle for placement of a 600 liter SFGC conduit with no reduction of ground clearance or interior volume within the mini van. The present invention is particularly useful for attaining the proposed California Super Ultra Low Emission Vehicle (SULEV) emission standard, and for attaining full-fuel-cycle emissions that are similar in magnitude to that of electric vehicles, taking into consideration emissions from the power plants that generate the electricity. While a 400 liter (106 gallon) SFGC containment volume is somewhat large for a passenger car, it is generally smaller, and extremely lighter and extremely less expensive than the lead acid and/or nickel-metal hydride batteries used on most electric vehicles. In some embodiments of the present invention described above, the SULEV emission standard can be attained with a SFGC conduit containment volume significantly smaller than 400 liters. For example, a SFGC conduit volume less than 226 liters is effective for attaining the SULEV standard in the high efficiency vehicle described above having fewer than three cylinders.

In contrast to the relatively small size of the SFGC conduit according to the present invention, tank 12*b* of system H shown in FIG. 3 is impractical for automotive applications due to its large size. For example, the tank illustrated in FIG. 3 is about fifteen times larger than the SFGC conduit 12 illustrated in FIG. 4. Thus tank 12*b* is impractical for use in passenger cars and light duty trucks because tank 12*b* is too large to install without substantially changing the shape and/or carrying capacity of the vehicle. Additionally, the contained gas volume within tank 12*b* is too large to be recycled back to the engine in the time available on typical driving trips, and consequently a significant portion of harmful exhaust emissions would be released to the atmosphere.

Referring now to FIG. 5, SFGC conduit 12 can be packaged into a vehicle 60 in the nose of the car (shown) underneath the trunk, into the rear quarter panels, behind the rear seat, or into other locations or combination of locations within vehicle 60 with no or only modest reductions of cargo space and/or with no or only modest other changes to the vehicle. According to the present invention, SFGC conduit 12, or an other type of exhaust gas container (such as conduit 12*e* shown in FIG. 7), inflatable bag 100 (shown in FIG. 9), or an other type of exhaust gas container may be placed in the nose of the vehicle (shown in FIG. 5), or an other place in the vehicle such as the rear end or sides of the vehicle, where the SFGC conduit 12 serves as a crash barrier and protects (and/or minimizes injury and/or damage of) the passengers of the vehicle, pedestrians hit by the vehicle, cargo on board the vehicle, or components of the vehicle in the event of an accident or crash. Vehicle 60 has a curb weight Cw, which is the weight of the vehicle without passengers, cargo and fuel. Referring now to FIG. 1, engine 1 has a displacement D. For piston engines, displacement is equal to the product of the full stroke of the piston in the cylinder bore times the cross-sectional area of the cylinder bore times the number of pistons (or summed for all of the pistons or chambers when the pistons or chambers are different in size). The SFGC conduit 12 can be located on the roof, between the wheels, or other locations of a truck, bus or other vehicle type.

Referring now to FIGS. 1, 4, 6*a*, 6*b*, 6*c*, and 7, the SFGC conduit can have various shapes and arrangements to minimize mixing of the segment of the exhaust gas stream containing harmful constituents and the second gas, and to provide lower cost and improved packaging into the vehicle. For example, the SFGC conduit can take the form of a single long conduit (shown in FIG. 1), a spiral wound conduit (shown in FIG. 4), a holding tank with flow guide vanes (shown in FIGS. 6*a* and 7), or a plurality of holding tanks of various sizes and shapes connected in series (shown in FIG. 6*c*) or in parallel (shown in FIG. 6*b*).

Figure 6A:
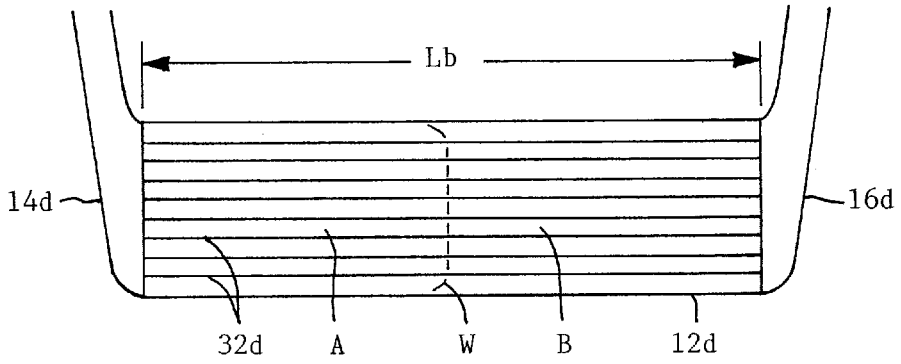
FIG. 6*a* schematically illustrates an SFGC conduits having flow guides.
Figure 6B:
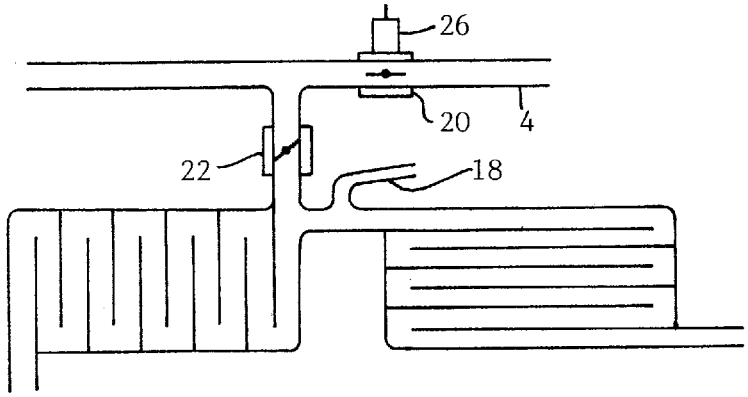
FIG. 6*b* schematically illustrates two SFGC conduits located in parallel.

Referring now to FIG. 7, the SFGC conduit 12*e* can have various shapes and arrangements of flow guides 32 to minimize mixing of the segment of the exhaust gas stream containing harmful constituents and the second gas. For example guide vanes 32 can be arranged in SFGC conduit 12*e* to provide a single long flow path. Referring now to FIG. 6*a*, flow guide vanes or pipes 32*d* minimize mixing of the segment of the exhaust gas stream containing harmful constituents A and the second gas B. Flow guides 32*d* divide SFGC conduit 12*d* into numerous adjacent flow channels where each flow channel has a cross sectional area which is substantially constant and much smaller than the cross sectional area of the SFGC conduit 12*d* as a whole. As a result of the smaller area, the flow guides prevent the harmful exhaust gas A from mixing to any great extent with the second gas B in SFGC conduit 12*d*. Flow guides 32*d* may be cooling pipes of a heat exchanger for cooling of the gas inside of the SFGC conduit 12*e*.

Referring now to FIG. 2*b*, SFGC conduit 12 has a length L, measured from valve 22 to the atmospheric outlet of two-directional flow pipe 16 (see FIGS. 1 and 2*b*), valve 81 (see FIG. 1*b*), or exhaust pipe 4 (see FIG. 7), and an average SFGC conduit circumference O (shown in FIG. 2*b*), where L and O are measured from the approximate centerline of the flow stream(s). SFGC conduit 12 has a containment volume Cv, which is the volume contained generally within conduit 12, and more specifically the volume contained within length L. The SFGC conduit length is greater than two (2) meters, and preferably the SFGC conduit length L is greater than three (3) meters, and/or the SFGC conduit 12 length L is greater than the average SFGC conduit circumference O, and the second gas B in the SFGC conduit 12 blocks flow of the segment of the exhaust gas containing harmful constituents A, except condensed and settled out constituents, out of the downstream end of SFGC conduit 12. The length and diameter of conduit 12 retain gas segments A and B in sequential alignment. Conduit 12 has a maximum circumference. Alternatively, the ratio of conduit length L to maximum conduit circumference is greater than one (1.0) for retaining gas segments A and B in sequential alignment, where segment B substantially blocks flow of segment A, except condensed and settled out constituents, out of the down stream end of conduit 12 before almost all of segment B is expelled from conduit 12.

Figure 6C:
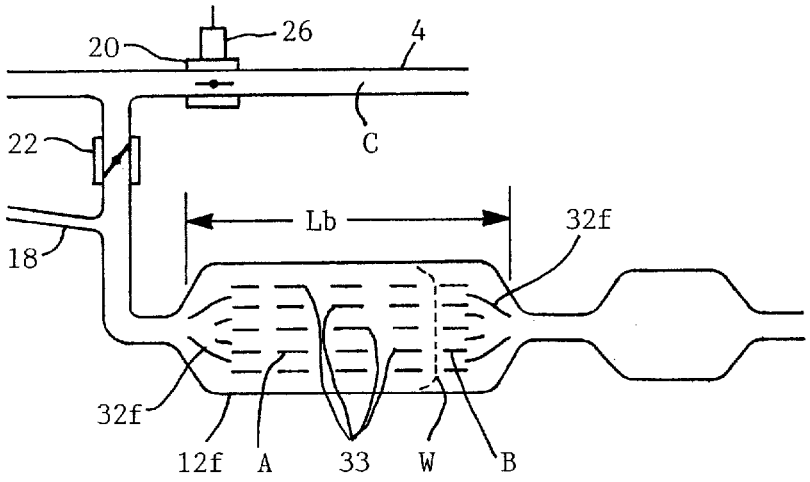
FIG. 6*c* schematically illustrates two SFGC conduits located in series.

Referring now to FIG. 6*a*, SFGC conduit 12*d* has a plurality of flow paths 32*d* each having a branch length Lb. FIG. 6*c* shows a SFGC conduit section 12*f* having flow guides 32*f* to establish multiple flow paths 33 to establish a wave front W to separate the segment of the exhaust gas stream containing harmful constituents A from the second gas B. As shown in FIG. 6*c*, the flow paths 33 are in fluid communication with each other, and each has a length Lb. In SFGC conduit systems having a plurality of flow paths, SFGC conduit length L is equal to the sum of the branch lengths Lb.

Referring to FIG. 1, the SFGC conduit can be made out of metal such as stainless steel or aluminum, or another material such as plastic. A temperature sensor 30 may be employed to detect whether the SFGC conduit 12 is overheated or about to become overheated. When temperature sensor 30 senses an overheat temperature, it informs the controller 28 that the SFGC conduit 12 is overheated, and the controller instructs the actuator 26 to open the valve 20 in order to terminate the flow of hot exhaust gas into the SFGC conduit 12 until the SFGC conduit cools down.

The system of the present invention can be used to trap dirty exhaust gas at any time the engine 1 is operating. For example, after the catalytic converter 2 has warmed up, there are moments when the exhaust emissions from the engine 1 are not effectively catalytically cleaned. For example, with spark ignition engines, during rapid changes of engine power, the fuel-air mixture can deviate from stoichiometric, which reduces catalytic converter effectiveness and results in harmful exhaust gas constituents flowing out of the down stream end of the catalytic converter 2. The present invention can also be employed with engines that do not have catalytic converters, or that do not have catalytic converters to reduce certain types of emissions. For example, diesel engines are known to have high particulate emission levels during hard acceleration. The system of the present invention also has particular usefulness on idle-off and/or hybrid vehicles, the operation of whose engines is frequently discontinued and then continued again while the vehicle is underway. During the period in which the engine of a hybrid vehicle is not operating, the temperature of its associated catalytic converter may fall below the temperature at which the catalytic converter is efficient. As a result, harmful exhaust emissions may not be effectively catalytically reduced each time the engine is restarted. As an other example, in lean burn engines, such as gasoline direct injection (GDI) engines (and in some diesel engines), the fuel-to-air mixture ratio is intentionally adjusted or perturbed (for example, run rich for a short period of time) to cleanse and/or purge the emissions trapping and/or reduction emissions control system, which results in high emission levels downstream of the catalytic converter for brief periods of time. The system of the present invention can go into operation each time the engine exhausts a segment of exhaust gas containing a high concentration of harmful constituents. The system of the present invention can go into operation each time the engine of the hybrid vehicle or conventional vehicle is restarted and/or each time the engine is operated with a lean or rich (e.g., non-stoichiometric) fuel-to-air mixture ratio, as described earlier. Consequently, the present invention reduces both engine starting emissions and also exhaust emissions encountered during warm engine operation.

Referring now to FIG. 1, the present invention may include an optional onboard diagnostic, or OBD, system that is on board the vehicle. The OBD system monitors operation of the present invention, and alerts the driver and/or the controller 28 or other emission system computer, or controller within the vehicle in the event that the OBD system detects an operational failure of the present invention. Specifically, the OBD system includes a first OBD sensor 9 that monitors operation of valves 20 and 22. As described previously, controller 28 instructs valve 20 to close causing valve 22 to open. Opening of valve 22 is sensed by OBD sensor 9. Failure of OBD sensor 9 to detect opening of valve 22 indicates failure of valve 22 and/or valve 20 to operate properly, and more generally failure of the emission control system according to the present invention to operate effectively. Controller 28 determines system failure and causes a warning light 80 to illuminate on the dash board or other location and/or sends a signal to the vehicle's controller 28 or other engine and/or emission control system. Controller 28 also instructs valve 20 to open and causes valve 22 to close. Closing of valve 22 is sensed by sensor 9 (or a second sensor, not shown). Failure of OBD sensor 9 to detect closure of valve 22 indicates failure of valve 22 and/or valve 20 to operate properly, and more generally failure of the emission control system according to the present invention to operate effectively. Controller 28 determines system failure and causes warning light 80 to illuminate on the dash board or other location and/or sends a signal to the vehicles controller 28 or other engine and/or emission control system. Those skilled in the art will appreciate that according to the present invention other sensors may be used to monitor effective operation of valves 20, 22, and 70 shown in FIGS. 1 and 7 respectively, and/or other sensors may be used to monitor flow into and out of conduit 12 and/or exhaust pipe 4.

Referring now to FIG. 1*b*, valve 81 may include an OBD sensor 83 for detecting opening and closing of valve 81. Specifically, the OBD system includes a first OBD sensor 9 that monitors operation of valves 20 and/or 22. As described previously, controller 28 instructs valve 20 to close causing valve 22 to open. Opening of valve 22 is sensed by OBD sensor 9. Failure of OBD sensor 9 to detect opening of valve 22 indicates failure of valve 22 and/or valve 20 to operate properly, and more generally failure of the emission control system according to the present invention to operate effectively. Additionally, valve 81 opens in response to increased pressure in conduit 12. Opening of valve 81 is sensed by OBD sensor 83. Failure of OBD sensor 83 to detect opening of valve 81 indicates failure of valve 81 to operate properly, a leak in conduit 12, failure of valves 20 and/or 22 to operate properly, and/or another type of system failure. Controller 28 determines system failure and causes a warning light 80 to illuminate on the dash board or other location and/or sends a signal to the vehicle's controller 28 or other engine and/or emission control system. Controller 28 also instructs valve 20 to open and causes valve 22 and valve 81 to close. Closing of valve 22 is sensed by sensor 9 (or a second closing sensor, not shown) and closing of valve 81 is sensed by sensor 83 (or a second closing sensor, not shown). Failure of OBD sensor 9 to detect closure of valve 22 and/or failure of OBD sensor 83 to detect closing of valve 81 indicates failure of valve 22, 81 and/or valve 20 to operate properly and/or a leak in conduit 12, and more generally failure of the emission control system according to the present invention to operate effectively. Controller 28 determines system failure and causes warning light 80 to illuminate on the dash board or other location and/or sends a signal to the vehicles controller 28 or other engine and/or emission control system. Failure of valves 20 and 22 may be detected by OBD sensor 83, and therefore OBD sensor 9 may optionally be omitted on some embodiments of the present invention. Those skilled in the art will appreciate that according to the present invention other sensors may be used to monitor effective operation of valves 20, 22, 81 and 70 shown in FIGS. 1 and 7 respectively, and/or other sensors may be used to monitor flow into and out of conduit 12 and/or exhaust pipe 4.

The California Air Resources Board has stated that a major problem with automobiles is that their emission control systems sometimes fail to operate satisfactorily, and vehicle owners sometimes do not have the emission control systems serviced for a long period of time, resulting in significant emission of harmful pollutants into the atmosphere. In contrast, electric vehicles do not release harmful air pollutants in the event of a powertrain system failure. While light duty vehicles may have OBD systems to alert the driver and/or vehicle inspection station personnel of an emission system failure, significant time may elapse before the driver has the vehicle repaired and/or inspected, and in some instances the vehicle owner may not have the vehicle serviced or inspected for a number of years. Operation of vehicles with failed emission control systems is a major source of air pollution, considering that non-methane organic gasses (NMOG) emissions exceed one gram per mile for a significant number of 1987 and newer model year cars having failed emission control systems (according to *Real-World Emissions from Model Year* 1993, 2000 *and* 2010 *Passenger Cars*, Michael Q. Wang, Argonne National Laboratory, et al., November 1995). In contrast, the proposed SULEV NMOG emission standard is 0.010 grams per mile (e.g., roughly one car with a failed emission control system may emits the same amount of NMOG emissions as 100 properly operating SULEV cars).

Referring to FIG. 1, according to the present invention, controller 28 or another emission system controller on board the vehicle may include a OBD secondary warning system or an OBD active response system 28AR that recognizes an emission control system failure, or a potential failure, and initiates an active response. The OBD and OBD active response systems are preferably combined, and the OBD active response system 28AR controller is preferably incorporated within, located inside of, or in close proximity to controller 28. Preferably, in addition to the OBD system causing a first OBD warning light to illuminate, the OBD active response system 28AR causes a secondary warning system to be activated that, in the event of a sustained emission system failure, initiates flashing of some or all of the vehicles lights 86, and/or honking of the vehicles horn 88, at some or all of the time engine 1 is running. The flashing lights and/or honking horn is anticipated to encourage the vehicle owner and/or operator to have the emission control system serviced. Alternatively, another type of active response may be initiated that encourages the driver to have the vehicle serviced, such as preventing restarting of the engine, delaying restarting of the engine, and/or limiting engine power output. According to the present invention, in the event that an emission control system failure is detected, a first OBD warning light is illuminated, as described previously. Preferably, the active response system 28AR will not be activated for some time after the first OBD warning light is illuminated and the initial OBD warning system has been activated, in order to avoid and/or minimize false alarms and unnecessary vehicle service and/or vehicle owner anxiety. In response to a detected emission control system failure, the active response system 28AR activates a trip meter (or sets into process a sequence of events that may activate the trip-meter) that counts the number of miles driven and/or the number of times the engine is started, and/or other data following detection of an emission control system failure such as elapsed time. After a predetermined number of miles driven, and/or a predetermined number of engine starts (or other value measured by the trip-meter, and/or another delay algorithm), such as 250 miles or 25 engine starts, the active response system 28AR will initiate flashing of some or all of the vehicle's lights and/or honking of the horn in the event that the vehicle is not serviced and/or in the event that the controller 28 or the active response system 28AR does not determine that the emission control system is operating satisfactorily (e.g., the emission control system has not reestablished satisfactory operation). Alternatively, the engine may not be allowed to restart or may only be allowed to restart only after a time delay. The controller 28 and/or active response system 28AR may delineate between major and minor emission control system failures, and for less severe emission system failures modes, may allow more restarts and/or a greater driving distance and/or time to be accumulated before the active response system 28AR causes the lights to flash and/or initiates honking of the horn and/or prevents restarting of the engine and/or initiates another type of active response for encouraging the vehicle owner and/or operator to have the vehicle serviced. Those skilled in the art will appreciate that my OBD active response system invention may be employed to prevent starting of engine 1 in the event that the SFGC conduit emission control system fails to operate satisfactorily, and my OBD active response system invention may be used with other known and unknown emission control systems, such as emission control systems currently sold in vehicles or expected to be sold in vehicles in the future to meet California and/or other tailpipe and evaporative emission regulations.

FIG. 7 shows an embodiment of the system of the present invention similar to that of FIG. 1 except that the two-directional flow pipe 16*e* is connected to the exhaust pipe 4 and that valve 20 and valve 22 are replaced by an optional combined valve 70. Except as specified hereafter, the embodiment of FIG. 7 operates in the same manner as the embodiment of FIG. 1. In the embodiment of FIG. 7, the second gas B is exhaust gas from the engine that has no or almost no harmful constituents. Consequently, the SFGC conduit 12*e* is always filled with exhaust gas, and only exhaust gas passes through the recirculation conduit 18 to the engine 1. A benefit of having only exhaust gas in conduit 12*e* is that only exhaust gas will be recycled to engine 1 through pipe 18. Exhaust gas recirculation, or EGR reduces oxides of nitrogen (NOx) exhaust gas emissions. Another benefit of substantially preventing entry of air into conduit 12*e* is that fuel vapor trapped in conduit 12*e* will not ignite (causing a backfire or explosion) due to the lack of oxygen. Valve 81 may be placed in pipe 16*e* to further prevent flow of air into SFGC conduit 12*e* (shown in FIG. 7*b*). Another benefit of connecting two-directional flow pipe 16*e* to exhaust pipe 4 is that exhaust passing through emissions trap 84 from exhaust pipe 4 is at an elevated temperature and will accelerate release of harmful emissions (such as hydrocarbons) from trap 84 into exhaust flowing into conduit 12*e*. Controller 28 may receive temperature readings from a temperature sensor, such as sensor 30*w* (shown in FIG. 1), and regulate flow of exhaust gas into conduit 12*e* to prevent overheating of emissions trap 84. According to the present invention, FIG. 7*b* shows a portion of FIG. 7, and includes an optional blower 24*b*. Referring to FIGS. 1, 7, and 7*b*, according to the present invention, valve 24 may be a conventional EGR valve having a control system that is optimized for the present invention, however, other valve systems can be used to regulate or aid flow of exhaust gas into intake manifold 5 of engine 1, such as an EGR blower 24*b* shown in FIG. 7*b*. EGR blower 24*b* may be used by itself, or in combination with valve 24, and exhaust flowing out of EGR blower 24*b* may be directed into manifold 5 or optionally into manifold 8 upstream of catalytic converter 2, or into the exhaust line upstream of catalytic converter 2, or another location effective for reducing harmful exhaust emissions. Valve 24*c* may be used to regulate flow from EGR blower 24*b* into manifold 8, and valve 24*c* may be controlled by controller 28 or may be closed by a spring and opened by the pressure of the exhaust gas flowing out of EGR blower 24*b*. Referring now to FIG. 1, according to the present invention a venturi V may be used to draw exhaust gas from conduit 12 into manifold 5. Venturi V improves flow of exhaust gas A into manifold 5 in some engines, such as engines having little or no intake manifold vacuum (e.g., the intake manifold pressure is near atmospheric), such as diesel engines, gasoline direct injection (GDI) engines, and engines having variable intake valve control. Referring now to FIGS. 1 and 7, as an alternative to connecting two-directional flow pipe 16*e* to exhaust pipe 4 (shown in FIG. 7), valve 20 may from time to time temporarily close exhaust pipe 4 and open valve 22 causing exhaust gas to flow into conduit 12 from exhaust pipe 4, so that only exhaust gas is at the inlet of recirculation pipe 18, and only exhaust gas flows into recirculation pipe 18.

Referring now to FIGS. 1 and 7, opening and closing of valve 24 may be initiated at various times. For example, the EGR system may recirculate exhaust gas only after the engine has warmed-up to normal operating temperature, and then only while the vehicle is cruising or accelerating. EGR flow may be cut off during idle, deceleration and cold engine operation to assure good combustion during these conditions. Accordingly, the EGR valve 24 of the present invention may not open for a period of time after the catalytic converter is warmed-up, however, as described previously, an objective of the present invention is to promptly recycle gas A. Alternatively, EGR valve 24 may be open at the same time valve 22 is open, for example during hard acceleration.

For engines having EGR entering the engine manifold 5, emissions are reduced and efficiency is improved most if the exhaust gas that is recirculated is cooled and, in some scenarios, its liquid and gaseous water content minimized. To provide for cooling of the exhaust gas that is recirculated back to the engine 1, the recirculation conduit 18 can be designed to cool the exhaust gases as it conducts the gases to the intake manifold 5 of the engine 1. For this purpose, the conduit 18 can be made of heat conductive material, such as aluminum or stainless steal. Furthermore, fins or other structures for enhancing heat transfer from the exhaust gases can be added to the conduit 18. Also for gas cooling purposes, a heat exchanger (not show) can be connected in series with conduit 14, between the exhaust pipe 4 and the SFGC conduit 12*e*, or placed around the SFGC conduit 12*e*, or placed in other locations of the present invention. Additionally, thermal barrier pipe couplings 33 can be provided in the conduit 14 and in the two-directional flow pipe 16*e* for reducing heat transfer from the hot exhaust pipe 4 to the SFGC conduit 12*e*. The SFGC conduit 12*e* and the recirculating conduit 18 are preferably located away from hot engine parts, in particular, hot exhaust system parts.

In addition to improving engine efficiency, use of cool EGR can also provide lower NOx emission levels than use of warm or hot EGR. As an alternative to cooling the EGR, according to the present invention the exhaust gas is trapped during start-up of the engine when it already is cool. Additionally, gas B in the SFGC conduit will have time to cool down when the engine is not in use. Specifically, EGR may be retained in conduit 12 for a cool-down period of time, and after the cool down period of time, recycled to the engine when nitrous oxide (NOx) emission levels from engine 1 are above a threshold value. Referring now to FIGS. 2*a*, 2*b*, 2*c*, and 7, according to the present invention, to provide an ample supply of cool EGR for reducing NOx emissions, an SFGC conduit larger in size than required for reducing NMOG emissions from cold starting of the engine may be employed. Preferably, according to the present invention, gas A is promptly recirculated to engine 1 after engine starting to ensure reduction of engine start-up emissions before use of the engine is terminated. Clean EGR (gas B as shown in FIG. 7) is then retained in the SFGC conduit, where it may cool down further over time. According to the present invention, the EGR retained in the SFGC conduit for a period of time, cools down in the SFGC conduit and is then directed into intake manifold 5 when engine 1 is operated at high loads to reduce NOx emission levels. In conventional engines high NOx emission levels occur during brief time intervals when the engine is operated at elevated power levels. Typically, the elevated power levels that cause high NOx emission levels last for only a few seconds. Preferably, the SFGC conduit has sufficient volume to supply cool EGR during these short periods of high power, that are responsible for high NOx emission levels.

With the cooling of the recirculating exhaust gas, the amount of water that is condensed out of the exhaust gas is increased. The recirculation pipe 18 and SFGC conduit 12*e* are inclined so that any condensation water will flow back towards the outlet to the atmosphere of exhaust pipe 4 or the atmospheric outlet of two-directional flow pipe 16. Additionally, the recirculation pipe 18 and SFGC conduit 12*e* can be continuously inclined downward towards the outlet to the atmosphere of exhaust pipe 4 so that water does not pool in the recirculation pipe 18 or the SFGC conduit 12*e* and block exhaust gas flow back to the engine 1. Drainage holes 35 can be provided in the flow guides 32 to aid in drainage.

An optional water drainage trap 34 is connected to the recirculation conduit 18 to drain condensed water from the conduit while preventing ambient air from being drawn into the conduit. Those skilled in the art will appreciate that more than one trap can be employed, and that the trap 34 can be attached to the recirculation conduit 18, the SFGC conduit 12*e*, or any other location requiring drainage. It will also be appreciated by those skilled in the art that other drainage arrangements can be employed to drain liquid water and prevent inflow of air, such as a water bypass 84*w* (shown in FIG. 1) or a floating ball valve.

It will be apparent to those skilled in the art, and it is contemplated, that variations and/or changes in the embodiments illustrated and described herein may be made without departure from the present invention. For example, other arrangements of valve and valve opening and closing sequences can be used. Accordingly, it is intended that the foregoing description is illustrative only, not limiting, and that the true spirit and scope of the present invention will be determined by the appended claims.

What is claimed is:

1. An apparatus for reducing the harmful exhaust gas emissions of an engine having an air intake, an exhaust gas flow stream from the engine, and an exhaust passage for carrying the exhaust gas flow stream from the engine to the atmosphere, wherein a first segment of the exhaust gas flow stream contains harmful constituents and a second segment of the exhaust gas flow stream contains non-harmful constituents, wherein said first segment is downstream of said second segment, comprising;

a conduit having a length, a diameter and a substantially fixed volume, and a third segment of gas having non-harmful constituents occupying said conduit before the inflow of the first segment of exhaust gas containing harmful constituents, one or more valves for preventing said first segment from flowing to the atmosphere and for directing said first segment into said conduit wherein said first segment of the exhaust gas flow stream containing harmful constituents is retained, said conduit having a length and diameter effective for retaining said first segments of said exhaust gas flow stream substantially upstream of said third segment of gas inside of said conduit during inflow of said first segment into said conduit, and means for recycling said first segment of the exhaust gas flow stream containing harmful constituents from said conduit to the engine, wherein said harmful constituents in said first segment of the exhaust gas flow stream are reduced.

2. The apparatus of claim 1, wherein said first segment of the exhaust gas flow stream containing harmful constituents is in fluid communication with said third segment and said third segment is in fluid communication with the atmosphere.

3. The apparatus of claim 1, wherein said third gas is exhaust gas from the engine.

4. The apparatus of claim 1, wherein said conduit has a length greater than two (2) meters.

5. The apparatus of claim 1, wherein said third segment blocks flow of said first segment, except condensed and settled out constituents, out of the downstream end of said conduit.

6. The method of claim 1 wherein, the conduit has a length, and a circumference for retaining said first segment and said third segment substantially in sequential alignment.

7. The apparatus of claim 1, wherein said conduit has a length, a maximum circumference, and a ratio of length to maximum circumference greater than one (1.0) for retaining said first and third segments in sequential alignment, wherein said third segment substantially blocks flow of said first segment containing harmful constituents, except condensed and settled out constituents, out of the downstream end of said conduit before almost all of said third segment is expelled from said conduit.

8. The apparatus of claim 1, wherein said conduit has a length and an average circumference, said length is greater than said average circumference, and said third segment blocks flow of the first segment containing harmful constituents, except condensed and settled out constituents, out of the downstream end of said conduit.

9. The apparatus of claim 1, wherein said conduit has a volume greater than 30 liters.

10. The apparatus of claim 1, wherein said engine has a displacement and said conduit has a volume at least thirty (30) times larger than said engine displacement.

11. The apparatus of claim 1, wherein at least 30 liters of said first segment is retained in said conduit.

12. The apparatus of claim 9, wherein said conduit has a first end in fluid communication with said exhaust passage for receiving said first segment, and a second end for inflow and outflow of said third segment of gas, said means for recycling said first segment includes a second conduit in fluid communication with said first conduit in close proximity to said first end for receiving said first segment, said first segment has a first flow direction into said conduit and said first segment has a second flow direction out of said conduit opposite from said first flow direction.

13. The apparatus of claim 1, wherein said vehicle has a weight and said conduit has a volume at least 0.025 liters per kilogram of vehicle weight.

14. The apparatus of claim 1, wherein said first segment is retained in said conduit at an elevated pressure, said pressure being greater than 10 pounds per square inch above atmospheric pressure.

15. The apparatus of claim 14, wherein said first segment is retained in said conduit at an elevated pressure less than 150 pounds per square inch.

16. The apparatus of claim 9, wherein said first segment contains harmful constituents and non-harmful constituents mixed together, said harmful constituents of said first segment are retained in said conduit in a gaseous state except for settled and condensed out constituents, and said gaseous harmful constituents of said first segment are mixed with said non-harmful constituents of said first segment within said conduit.

17. The method of purifying segments of an exhaust gas stream from an engine containing harmful and non-harmful constituents comprising the steps of:

blocking the exhaust passage downstream of the engine when a segment of the exhaust gas stream contains harmful constituents to thereby prevent emission of harmful constituents into the atmosphere, directing the segment of the exhaust gas stream containing harmful constituents to a conduit effective to retain the exhaust gas containing harmful constituents within the conduit upstream of a second gas occupying the conduit before the inflow of the exhaust gas containing harmful constituents, wherein the conduit has a substantially fixed volume, opening the exhaust passage and blocking flow of the exhaust gas into the conduit to thereby retain within the conduit the segment of the exhaust gas stream containing harmful constituents, and recycling the segment of the exhaust gas stream containing harmful constituents from the conduit, except condensed and settled out constituents, through the engine, whereby the segment of the exhaust gas stream containing harmful constituents are reduced.

18. The method of claim 17, further including the step of opening the exhaust passage and blocking flow of exhaust into the conduit before the exhaust gas entering the upstream end of the conduit forces the exhaust gas containing harmful constituents out of the downstream end of the conduit.

19. The method of claim 17, further including the steps of retaining exhaust gas in said conduit for a cool-down period of time, and recycling said exhaust gas, now cooled down, from said conduit to said engine when nitrous oxide emission levels from said engine are above a threshold value.

20. The method of reducing exhaust of harmful gases from an engine comprising the steps of:

passing the gases through an exhaust gas reaction device effective to cause reaction of harmful exhaust gas constituents when the temperature of said reaction device is above a minimum temperature, blocking said exhaust passage downstream of said reaction device when the temperature of said reaction device is below said minimum temperature to thereby prevent emission of unreacted exhaust gas constituents to the atmosphere, directing exhaust gases flowing unreacted from said reaction device when the temperature of said reaction device is below said minimum temperature to a conduit effective to retain said exhaust gas constituents within said conduit, except condensed and settled out constituents, substantially upstream of a second gas occupying said conduit before the inflow of said exhaust gas, wherein the conduit has a substantially fixed volume greater than 30 liters, opening the exhaust passage and blocking flow of the exhaust gas into said conduit to thereby contain within said conduit the segment of the exhaust gas stream containing harmful constituents, and recycling the exhaust gas from said conduit, except condensed and settled out constituents, through said reaction device when the temperature of said reaction device is above said minimum temperature, whereby exhaust gas constituents passed unreacted through said reaction device when the temperature of said reaction device is below said minimum temperature are recycled through and reacted in said reaction device when the temperature of said reaction device is above said minimum temperature.

21. The method of claim 20, further including the step of recycling almost all of said unreacted exhaust gasses to said reaction device within less than 20 minutes of engine starting.

22. The method of claim 20, further including the step of recycling almost all of said unreacted exhaust gasses to said reaction device within less than five miles of vehicle travel following engine starting.

* * * * *